US012061074B2

(12) United States Patent
Treadway et al.

(10) Patent No.: US 12,061,074 B2
(45) Date of Patent: Aug. 13, 2024

(54) MUNITIONS AND METHODS FOR OPERATING SAME

(71) Applicant: Corvid Technologies LLC, Mooresville, NC (US)

(72) Inventors: Sean Kevin Treadway, Mooresville, NC (US); Erik Charles Wemlinger, Mooresville, NC (US); Michael John Worsham, Mooresville, NC (US); James Edward Painter, III, Mooresville, NC (US)

(73) Assignee: Corvid Technologies LLC, Mooresville, NC (US)

( * ) Notice: Subject to any disclaimer, the term of this patent is extended or adjusted under 35 U.S.C. 154(b) by 2 days.

(21) Appl. No.: 18/170,484

(22) Filed: Feb. 16, 2023

(65) Prior Publication Data

US 2024/0151503 A1 May 9, 2024

Related U.S. Application Data

(63) Continuation of application No. 17/127,505, filed on Dec. 18, 2020, now Pat. No. 11,609,073, which is a continuation-in-part of application No. 16/745,016, filed on Jan. 16, 2020, now abandoned.

(60) Provisional application No. 62/955,608, filed on Dec. 31, 2019, provisional application No. 62/821,645, filed on Mar. 21, 2019.

(51) Int. Cl.
*F42B 12/60* (2006.01)
*F42B 12/32* (2006.01)

(52) U.S. Cl.
CPC ..... *F42B 12/60* (2013.01); *F42B 12/32* (2013.01)

(58) Field of Classification Search
CPC ..... F42B 12/32; F42B 12/56; F42B 12/58; F42B 12/60; F42B 12/62; F42B 12/64; F42B 12/745
USPC ..... 102/495, 496
See application file for complete search history.

(56) References Cited

U.S. PATENT DOCUMENTS 1,277,271 A * 8/1918 Sutch ..... F42B 12/58 89/1.51
1,289,483 A * 12/1918 Leal ..... F42B 12/58 102/388
2,925,965 A * 2/1960 Pierce ..... F42C 19/095 342/67
3,857,338 A * 12/1974 Bucklisch ..... F42B 12/58 102/383
3,938,442 A 2/1976 Donadio
3,948,175 A * 4/1976 Bucklisch ..... F42B 12/58 102/480

(Continued)

OTHER PUBLICATIONS

Dormehl, Luke "DroneBullet is a kamikaze drone missile that knocks enemy UAVs out of the sky" From URL: https://www.digitaltrends.com/cool-tech/dronebullet-anti-drone-tech/ (May 5, 2019).

(Continued)

*Primary Examiner* — Joshua E Freeman
(74) *Attorney, Agent, or Firm* — Myers Bigel, P.A.

(57) ABSTRACT

A warhead includes a gas generator, a plurality of barrels, and a plurality of projectiles. The warhead is configured to selectively actuate the gas generator to generate a pressurized gas that energetically propels the projectiles through and out from the barrels to strike a target.

23 Claims, 20 Drawing Sheets

(56) References Cited

U.S. PATENT DOCUMENTS

| | | | | | |
|---|---|---|---|---|---|
| 4,172,407 | A * | 10/1979 | Wentink | F42B 12/60 | 102/480 |
| 4,444,117 | A * | 4/1984 | Mitchell, Jr. | F42B 12/58 | 102/489 |
| 4,688,486 | A | 8/1987 | Hall et al. | | |
| 4,714,020 | A | 12/1987 | Hertsgaard et al. | | |
| 4,903,602 | A * | 2/1990 | Skagerlund | G01S 7/4861 | 102/213 |
| 5,014,590 | A * | 5/1991 | Moggert | F42B 12/58 | 89/1.51 |
| 5,182,418 | A * | 1/1993 | Talley | F42C 19/095 | 102/211 |
| 5,535,679 | A * | 7/1996 | Craddock | F42B 12/32 | 102/389 |
| 6,779,462 | B2 | 8/2004 | Lloyd | | |
| 7,066,093 | B2 | 6/2006 | Ronn et al. | | |
| 7,530,315 | B2 | 5/2009 | Tepera et al. | | |
| 7,624,683 | B2 | 12/2009 | Lloyd | | |
| 7,752,976 | B2 * | 7/2010 | Banks | F42B 12/06 | 102/489 |
| 8,127,686 | B2 | 3/2012 | Lloyd | | |
| 8,904,936 | B2 | 12/2014 | Treadway et al. | | |
| 9,062,954 | B2 | 6/2015 | Treadway et al. | | |
| 9,068,803 | B2 * | 6/2015 | Roemerman | F42B 8/22 | |
| 9,297,619 | B1 * | 3/2016 | Al-Qanaei | F42B 5/10 | |
| 9,683,822 | B2 | 6/2017 | Kerns et al. | | |
| 10,982,942 | B1 * | 4/2021 | Stowe | F42D 5/045 | |
| 11,199,380 | B1 * | 12/2021 | Ekhaus | F41G 7/226 | |
| 2009/0205529 | A1 | 8/2009 | Lloyd | | |
| 2014/0113086 | A1 | 4/2014 | Greenhill et al. | | |
| 2015/0323287 | A1 * | 11/2015 | Durand | F41G 7/2286 | 244/3.19 |
| 2016/0231096 | A1 * | 8/2016 | Kerns | F42B 12/32 | |
| 2020/0348117 | A1 * | 11/2020 | Feda | F42C 17/04 | |
| 2020/0393229 | A1 * | 12/2020 | Feda | F42C 11/002 | |

OTHER PUBLICATIONS

Lewis, Jeffrey "Multiple Kill Vehicles (MKV)" Arms Control Work, From URL: https://www.armscontrolwonk.com/archive/200781/multiple-kill-vehicles-mkv/ (Sep. 12, 2005).

* cited by examiner

MUNITIONS AND METHODS FOR OPERATING SAME

RELATED APPLICATION

The present application is a continuation of and claims priority from U.S. patent application Ser. No. 17/127,505, filed Dec. 18, 2023, which claims the benefit of and priority from U.S. Provisional Patent Application No. 62/955,608, filed Dec. 31, 2019. This application is also a continuation-in-part of and claims priority from U.S. patent application Ser. No. 16/745,016 filed Jan. 16, 2020, which claims priority from U.S. Provisional Patent Application No. 62/821,645 filed Mar. 21, 2019, in the United States Patent and Trademark Office. The disclosures of these applications are incorporated by reference herein in their entireties.

FIELD

The present invention relates to munitions and, more particularly, to munitions including projectiles.

BACKGROUND

Munitions such as bombs and missiles are used to inflict damage on targeted personnel and material. Some munitions of this type include a warhead including a plurality of projectiles and high explosive to project the projectiles at high velocity.

SUMMARY

According to some embodiments, a warhead includes a gas generator, a plurality of barrels, and a plurality of projectiles. The warhead is configured to selectively actuate the gas generator to generate a pressurized gas that energetically propels the projectiles through and out from the barrels to strike a target.

In some embodiments, the gas generator includes a combustible gas generating material. When the gas generator is actuated, the gas generating material is combusted to generate the pressurized gas.

According to some embodiments, the gas generating material is an explosive material.

In some embodiments, when the gas generator is actuated, the gas generating material deflagrates and is not detonated.

In some embodiments, the gas generating material is a low explosive material.

According to some embodiments, the gas generating material is a high explosive material.

According to some embodiments, the warhead has a leading end and an opposing trailing end, and a warhead axis extending in a forward direction from the trailing end to the leading end, and at least some of the barrels have a barrel axis that extends radially outward relative to the warhead axis.

In some embodiments, at least some of the barrels have a barrel axis the forms an oblique barrel angle relative to the warhead axis.

In some embodiments, at least some of the barrels have a barrel axis that forms an acute barrel angle relative to the warhead axis in the forward direction.

In some embodiments, at least some of the barrels have different barrel angles from one another.

According to some embodiments, the warhead includes a pressure distribution manifold configured to direct the pressurized gas from the gas generator to the barrels.

In some embodiments, a plurality of the barrels are fluidly coupled to the pressure distribution manifold at circumferentially and axially distributed locations about the pressure distribution manifold.

In some embodiments, at least some of the barrels are provided with a gas restriction section between the pressure distribution manifold and the barrel, and the gas restriction section is configured to regulate a gas pressure from the pressure distribution manifold into the barrel.

According to some embodiments, the warhead includes a warhead body, and the pressure distribution manifold and the barrels are defined in the warhead body.

In some embodiments, the warhead body has an outer surface, and exit ports of the barrels are defined in the outer surface of the warhead body.

According to some embodiments, the warhead includes a cover sheet covering the exit ports.

In some embodiments, the warhead includes muzzle plugs disposed in the exit ports.

According to some embodiments, the gas generator includes a container and the gas generating material disposed in the container, and the gas generator is mounted on the warhead body to direct the pressurized gas into the manifold.

According to some embodiments, the manifold is a tubular chamber.

In some embodiments, the warhead includes a volume reducer member than defines an inner boundary of the tubular chamber.

In some embodiments, each barrel includes: a breech section and projectile guide section; at least one projectile mounted in the breech section thereof; and a retainer plug holding the at least one projectile in the breech section until the gas generator is actuated.

According to some embodiments, at least some of the projectiles are spherical.

According to some embodiments, at least some of the projectiles are disc-shaped.

In some embodiments, the warhead includes at least 20 barrels.

According to some embodiments, at least one of the barrels includes multiple projectiles disposed therein to be fired.

In some embodiments, the warhead includes a gas generator actuation system configured to actuate the gas generator.

According to some embodiments, the gas generator actuation system includes a hot wire.

In some embodiments, the gas generator actuation system includes a shock initiation device.

According to some embodiments, a munition includes a munition platform and a warhead on the munition platform for flight therewith. The warhead includes a gas generator, a plurality of barrels, and a plurality of projectiles. The warhead is configured to selectively actuate the gas generator to generate a pressurized gas that energetically propels the projectiles through and out from the barrels to strike a target.

In some embodiments, the munition includes a seeker subsystem. The munition is operative to actuate the gas generator responsive to a signal from the seeker subsystem.

In some embodiments, the seeker subsystem includes a height of burst (HOB) sensor, and the munition is operative to actuate the gas generator responsive to a signal from the HOB sensor.

In some embodiments, the munition platform includes a propulsion system.

According to some embodiments, a method for damaging a target includes providing a warhead including: a gas generator; a plurality of barrels; and a plurality of projectiles. The method further includes actuating the gas generator to generate a pressurized gas that energetically propels the projectiles through and out from the barrels to strike a target.

In some embodiments, the warhead includes a warhead body including the barrels, the energetically propelled projectiles form a cone of effect, and the warhead remains substantially intact and impacts within the cone of effect.

BRIEF DESCRIPTION OF THE DRAWINGS

The accompanying figures are included to provide a further understanding of the present invention, and are incorporated in and constitute a part of this specification. The drawings illustrate some embodiments of the present invention and, together with the description, serve to explain principles of the present invention.

DESCRIPTION

Figure 1:
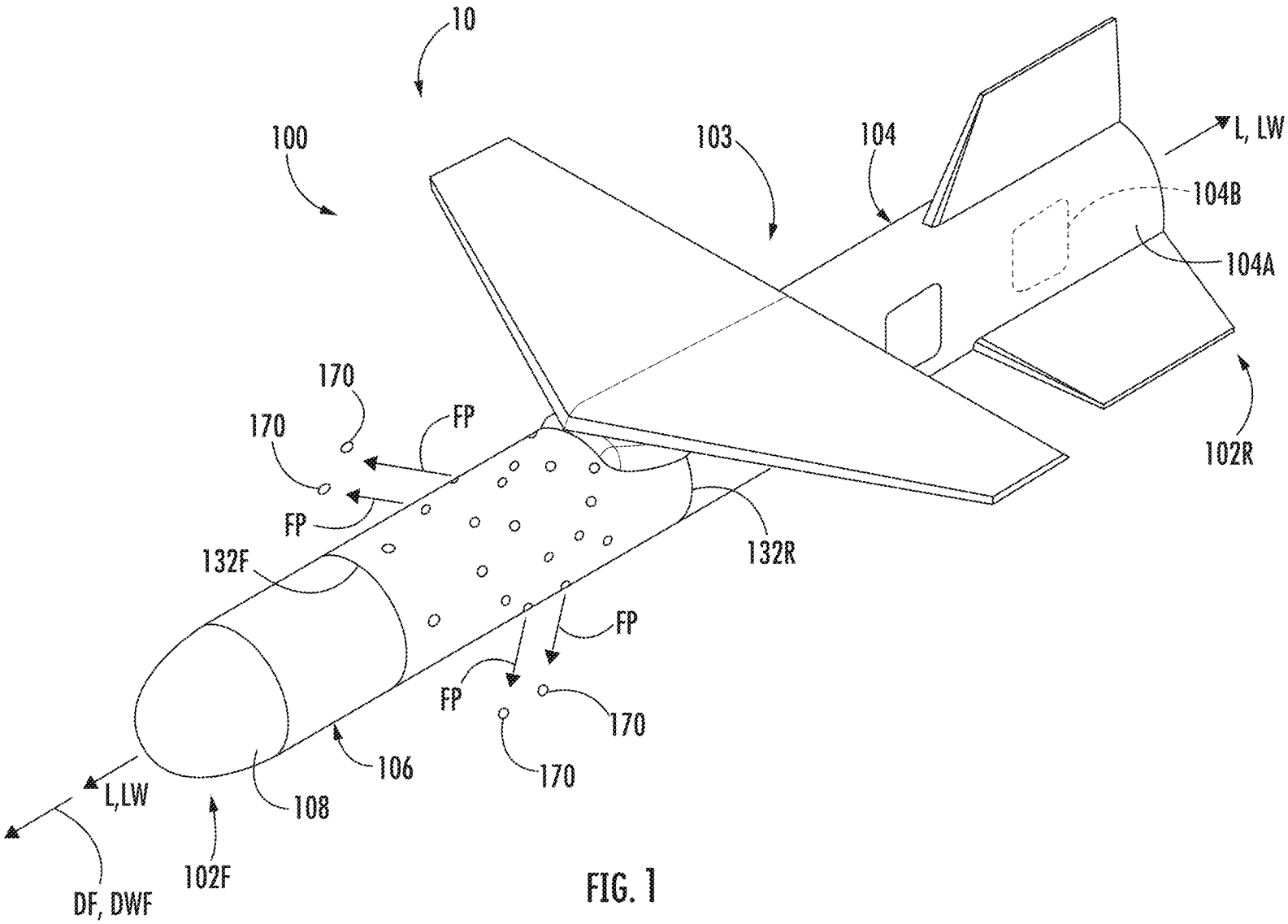
FIG. 1 is a front perspective view of a munition according to some embodiments.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As used herein, "monolithic" means an object that is a single, unitary piece formed or composed of a material without joints or seams.

The term "automatically" means that the operation is substantially, and may be entirely, carried out without human or manual input, and can be programmatically directed or carried out.

The term "programmatically" refers to operations directed and/or primarily carried out electronically by computer program modules, code and/or instructions.

The term "electronically" includes both wireless and wired connections between components.

In "deflagration" of an explosive material, decomposition of the explosive material is propagated by a flame front which moves relatively slowly through the explosive material at speeds less than the speed of sound within the explosive material substance (usually below 1000 m/s). This is in contrast to "detonation", which occurs at speeds greater than the speed of sound.

Embodiments of the invention relate to munitions such as missiles and bombs intended for use against personnel and materiel. Specifically, the invention enables the selective projection of projectiles from a warhead with a projectile projection energy. The projectile projection energy is a combination of weapon terminal velocity and propulsion energy provided by a gas generator of the warhead. In some embodiments, the gas generator uses a non-high explosive chemical explosion to produce an explosive energy release, which serves as the projectile propulsion energy.

According to some embodiments of the invention, a warhead includes a gas generator, a plurality of barrels, and a plurality of projectiles. The warhead is configured to selectively operate the gas generator to generate a pressurized gas that energetically propels the projectiles through and out from the barrels to strike a target. The gas generator includes a gas generating material from which the gas generator generates the pressurized gas when actuated. In some embodiments, the gas generator material is a combustible gas generating material. In some embodiments, the gas generator material is an explosive. In some embodiments, the gas generator material is an explosive material that generates the pressurized gas by deflagrating.

In some embodiments, the gas generator material is not detonated to produce the pressurized gas, and the projectiles are not propelled by the force of a detonated high explosive (HE). Instead, the energy from the gas generator can be controlled and focused. As a result, the uncontrolled energy of a HE detonation is avoided, which may greatly reduce the risk of unintended collateral damage. In some embodiments, no portion of the warhead or munition is fragmented when the warhead is actuated.

In some embodiments, the warhead projects a relatively dense projectile pattern that increases the probability of target hits ($P_h$), and generally more projectile energy is delivered to the target. Increased projectile energy on the target increases the overall probability of target kill ($P_k$). Focused projection of projectiles also sharply reduces area of effect, thereby reducing the potential for collateral damage. In some embodiments, the dispersion is generally a cone shape. The effect is an area of projectile impact in an expanding circular area normal to the forward direction of flight or longitudinal axis of the munition.

In some embodiments, the warhead is constructed such that, when actuated, the warhead remains substantially fully intact (with the exception of the gas generator, which is destroyed by ignition, and the projectiles that are ejected from the warhead).

In some embodiments, the warhead includes a warhead housing or body. The barrels are defined in the warhead body and each have an exit port in a sidewall of the warhead body. In some embodiments, the exit ports are distributed axially along the warhead body. In some embodiments, the exit ports are distributed circumferentially about the warhead body. In some embodiments, the exit ports are distributed both axially along and circumferentially about the warhead body.

In some embodiments, a pressure distribution manifold is provided in the warhead body. The gas generator is configured to pressurize the pressure distribution manifold. The barrels each intersect and fluidly communicate with the pressure distribution manifold. The pressure from the gas generator is distributed to the barrels through the pressure distribution manifold. The pressure distribution manifold may be a central gas chamber that is substantially radially centrally located between the barrels.

In some embodiments, the warhead is configured to fire, shoot or project the projectiles forwardly with respect to the direction of travel of the warhead (i.e., the direction of travel of the platform (e.g., missile) carrying the warhead). The warhead may be configured to focus, contain or concentrate the paths of the projectiles in a relatively small area.

In some embodiments, at least some of the barrels (and, in some embodiments, multiple barrels) are angled forward and acutely relative to the direction of travel of the warhead. In this case, the projection energy from the gas generator tends to drive the projectiles in a forward and radially outward direction.

The velocity imparted by the gas generator and the velocity of the warhead combine to provide the projectiles with an enhanced velocity. This enhanced velocity increases the lethality of the projectiles.

The warhead may be actuated in any suitable manner to fire the projectiles. In some embodiments, the gas generator is triggered by a height of burst (HOB) sensor device so that the projectiles are fired at a prescribed height above the ground. In some embodiments, the gas generator is actuated by a hot wire. In some embodiments, the gas generator is actuated by a shock initiation device.

In some embodiments, the deployed velocities and strike pattern of the projectiles are selectively configured by selection of one or more design parameters. In some embodiments, these parameters include one or more of the following: prescribed triggering HOB; platform (e.g., missile) velocity; open volume of central pressure chamber; angles of barrels; lengths of barrels; sizes of projectiles; pressure constrictors between central pressure chamber and barrels; and pressure energy output of the gas generator.

Figure 5:
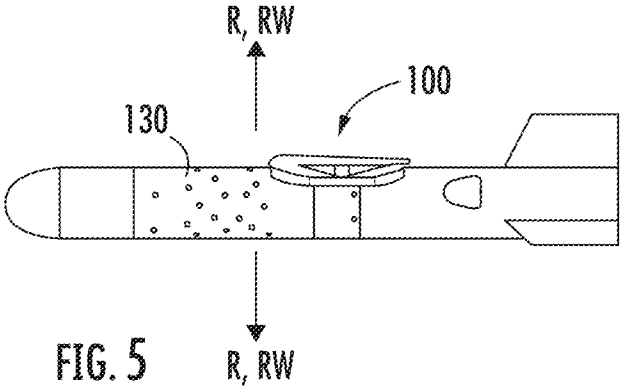
FIG. 5 is a side view of the munition of FIG. 1.
Figure 3:
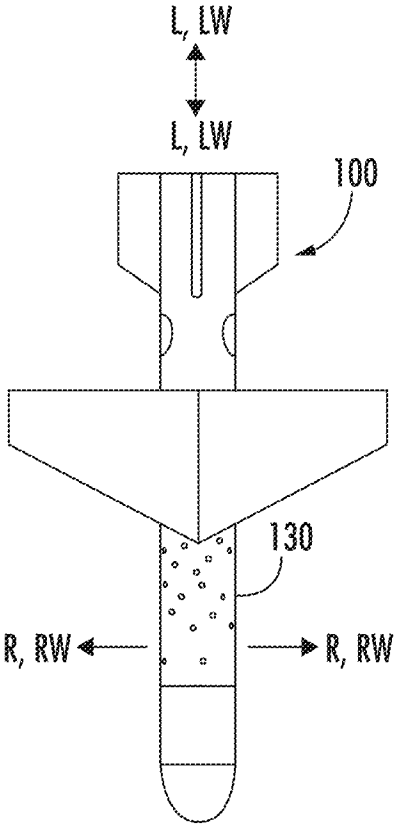
FIG. 3 is a top view of the munition of FIG. 1.
Figure 2:
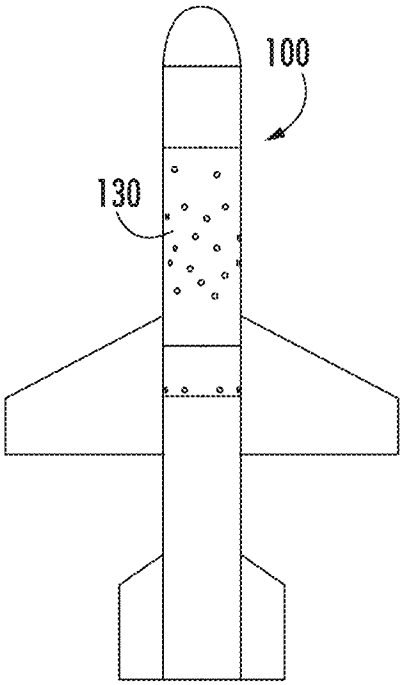
FIG. 2 is a bottom view of the munition of FIG. 1.
Figure 6:
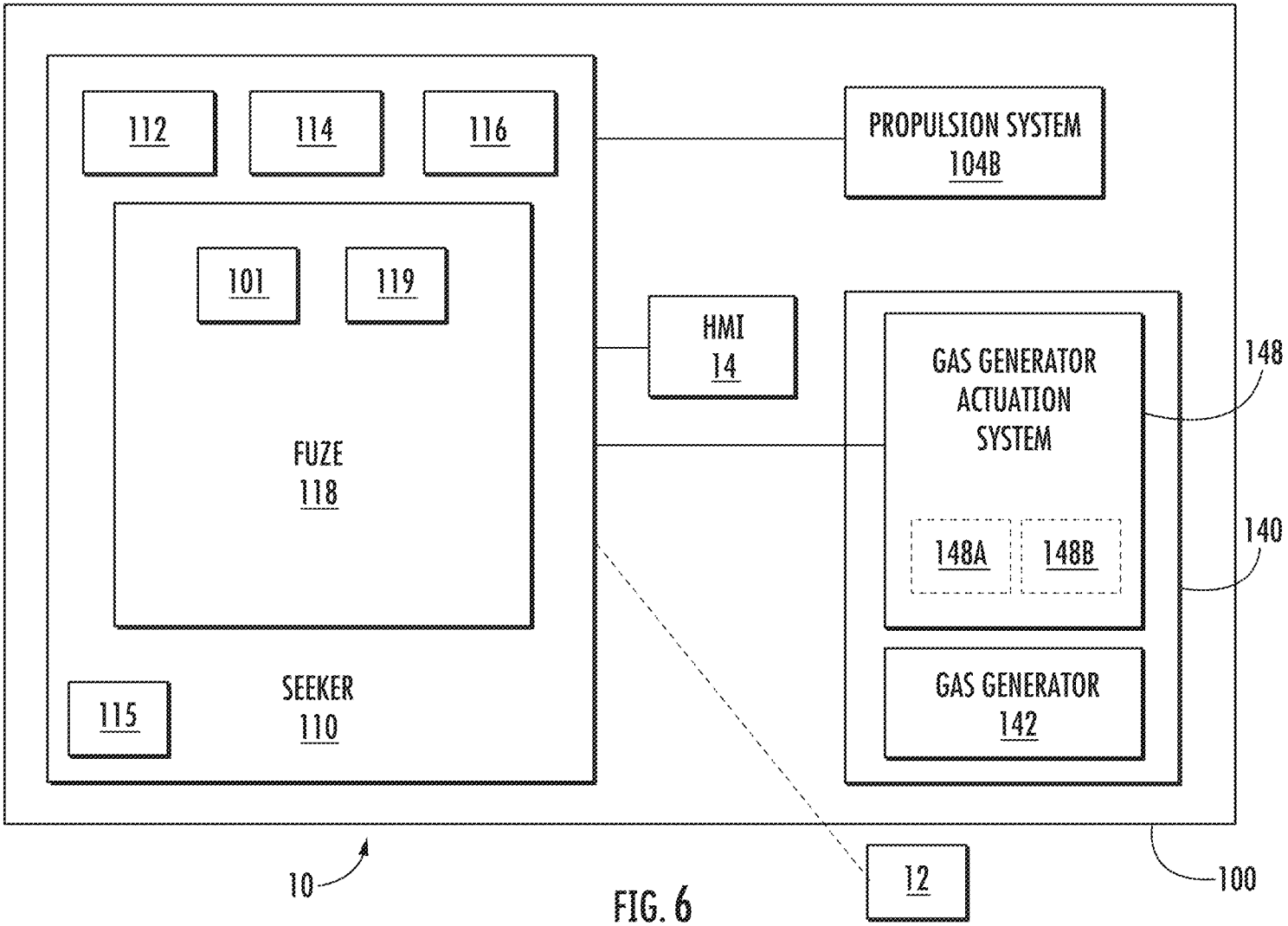
FIG. 6 is a schematic diagram representing a munition system including the munition of FIG. 1.

With reference to FIGS. 1-18, a munition system 10 according to embodiments of the invention is shown therein. The system 10 includes a munition 100 and, optionally, a remote controller 12 (FIG. 6). The system 10 may be used to apply a lethal or destructive force to a target E (FIG. 7 using high energy projectiles 170 of the munition 100.

The illustrated munition 100 is a missile. However, embodiments of the invention may be used in other types of munitions, such as bombs (e.g., smart bombs). In some embodiments, the munition 100 is a precision guided munition. In use, the munition 100 travels generally in a direction of flight DF.

In the illustrated embodiment, the munition 100 includes a munition or missile platform 103 and a warhead 130 according to some embodiments of the invention. However, other missile designs may be used including, for example, the AGM-176 Griffin (Raytheon), the GBU-39 SDB (Small Diameter Bomb, Boeing), the GBU-53/B SDB II, and the Small Glide Munition (SGM) platform (GBU-69/B SGM, Dynetics).

Figure 4:
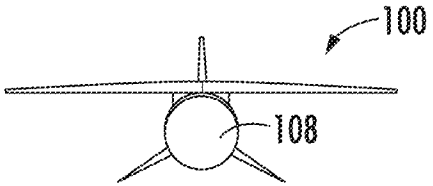
FIG. 4 is a front end view of the munition of FIG. 1.

The munition 100 has a front end 102F and a rear end 102R. The munition 100 has a longitudinal or primary axis L-L. The munition 100 also has radial axes (two such radial axes R-R are indicated in FIGS. 4 and 5) that extend perpendicular to the longitudinal axis L-L. The munition 100 is configured to travel or fly in the forward direction DF along the longitudinal axis L-L. The munition 100 includes a front section 106 adjacent the front end 102F, and a rear section 104 adjacent the rear end 102R.

The rear section 104 serves as the propulsion section. The rear section 104 includes a housing or shell 104A. A propulsion system 104B is housed in the housing 104A. The rear section 104 may further include wings or other guidance components.

The front section 106 serves as the operational warhead section. The front section 106 includes a nose section 108 and the warhead 130. In the depicted embodiment, the warhead 130 is disposed directly behind the nose section 108, but other configurations are possible.

The nose section 108 includes a nose shell or cone fairing 108A. A seeker subsystem 110 (FIG. 6) is housed within the nose fairing 108A. The seeker subsystem 110 may include a guidance controller 112, a communications transceiver 114, a height of burst (HOB) sensor 115, a targeting detection device or system 116, and/or a fuze 118. The fuze 118 may include an operational controller 101, and a high voltage (HV) supply 119.

The HOB sensor 115 is configured to determine an altitude of the munition 100 above the ground, which measurement may serve as an approximation of the instantaneous distance from the munition 100 to the target E. However, other targeting detection sensors, devices or systems may be used in place of or in addition to the HOB sensor 115. The HOB sensor 115 may be or form a part of the targeting detection system 116.

The operational controller 101 may be any suitable device or processor, such as a microprocessor-based computing device. While the operational controller 101 is described herein as being a part of the fuze 118, any suitable architectures or constructions may be used. For example, the functionality of the operational controller 101 may be distributed across or embodied in one or more controllers forming a part of the fuze 118, one or more controllers not forming a part of the fuze 118, or one or more controllers in the fuze 118 and one or more controllers not in the fuze 118.

The munition 100 or the warhead 130 may be provided with an input device or human-machine interface (HMI) 14. The HMI 14 and/or the remote controller 12 may be used by an operator to provide inputs (e.g., settings, other commands) to the controller 101 and/or to report a status of the warhead 130.

According to some embodiments, the fuze 118 is external of the warhead 130 (e.g., in the nose section 108 as described above). This may be advantageous in that is allows the warhead 130 to be used with existing munition designs. However, in other embodiments, the fuze 118 can be integrated into the warhead 130.

The warhead 130 has a front or leading end 132F and a rear or trailing end 132R spaced apart along the longitudinal axis LW-LW (which extends substantially parallel or coaxial with the munition primary axis L-L). The warhead 130 also has radial axes (two such radial axes RW-RW are indicated in FIGS. 4 and 5) that extend perpendicular to the longitudinal axis LW-LW. The longitudinal axis LW-LW extends in a warhead forward direction DWF in the direction from the trailing end 132R to the leading end 132F.

Figure 14:
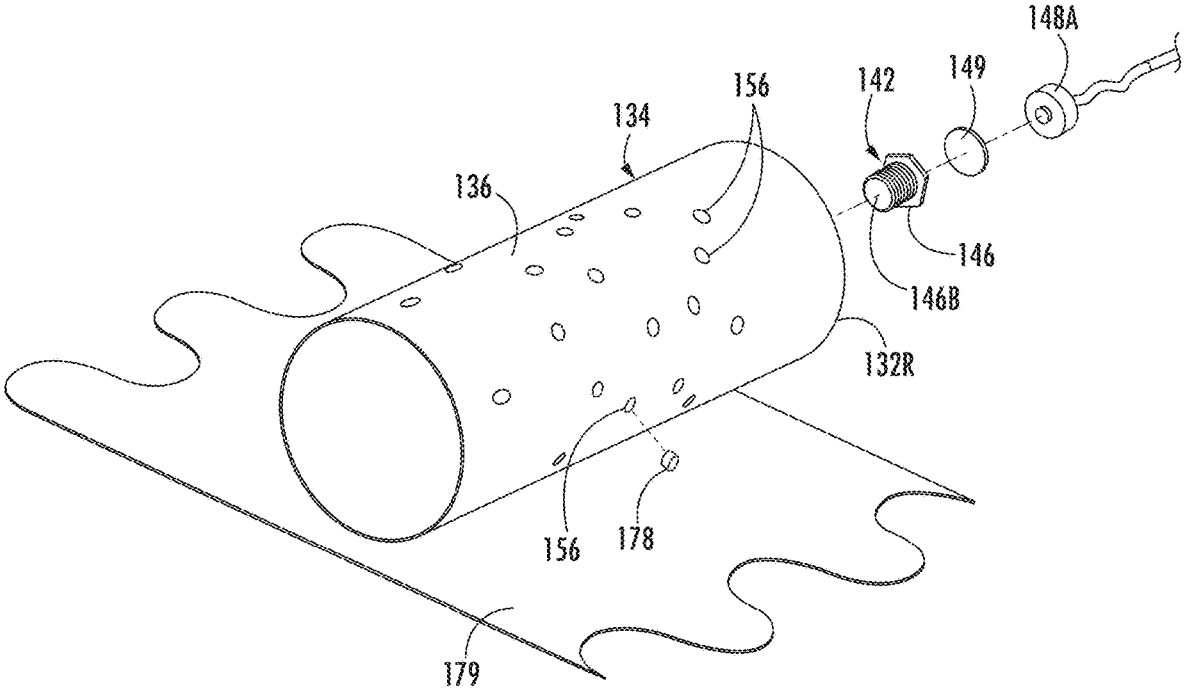
FIG. 14 is an exploded, front perspective view of the warhead of FIG. 13.

The warhead 130 includes a load carrying warhead primary structure, frame, housing or body 134, a gas generation system 140 (FIG. 6), a plurality of barrels 150, a pressure delivery system 160, a plurality of the projectiles 170, and a plurality of retainer plugs 176. The warhead 130 may further include a cover 179 and/or exit port plugs 178 (FIG. 14).

The illustrated warhead primary structure 134 is a solid body into which the other warhead features and component are formed or mounted to form a unitary warhead assembly. However, the warhead primary structure 134 may take other forms in accordance with other embodiments.

The warhead body 134 has a front end at the warhead leading end 132F, and opposing rear end at the warhead trailing end 132R, and an outer or exterior surface or sidewall 136. In some embodiments, the sidewall 136 is substantially cylindrical. The sidewall 136 forms the outer mold line (OML) of the warhead 130.

The warhead body 134 integrates the warhead 130 to the remainder of the munition 100, and is designed to carry handling, vibrational and aerodynamic loads as required by the munition operational specifications. The warhead body 134 may further include provisions for structural attachment to the missile body parts 104, 106 or other hardware (e.g., hard points such as threaded holes or a threaded end, not shown)

In some embodiments, the warhead body 134 is a solid body into which some of or all the barrels 150 are formed. In other embodiments, the barrels 150 may be formed as separate members that are secured to the warhead body 134.

The warhead body 134 may be formed of any suitable material(s). In some embodiments, the warhead body 134 is formed of metal or polymer to meet the load requirements of missile operation. Suitable materials may include 7075-T7351 or nylon 6/6, for example.

In some embodiments, the warhead body 134 has a length L3 (FIG. 11) in the range of from about 20 cm to 100 cm, and an outer diameter W3 (FIG. 11) in the range of from about 11 cm to 26 cm.

Figure 15:
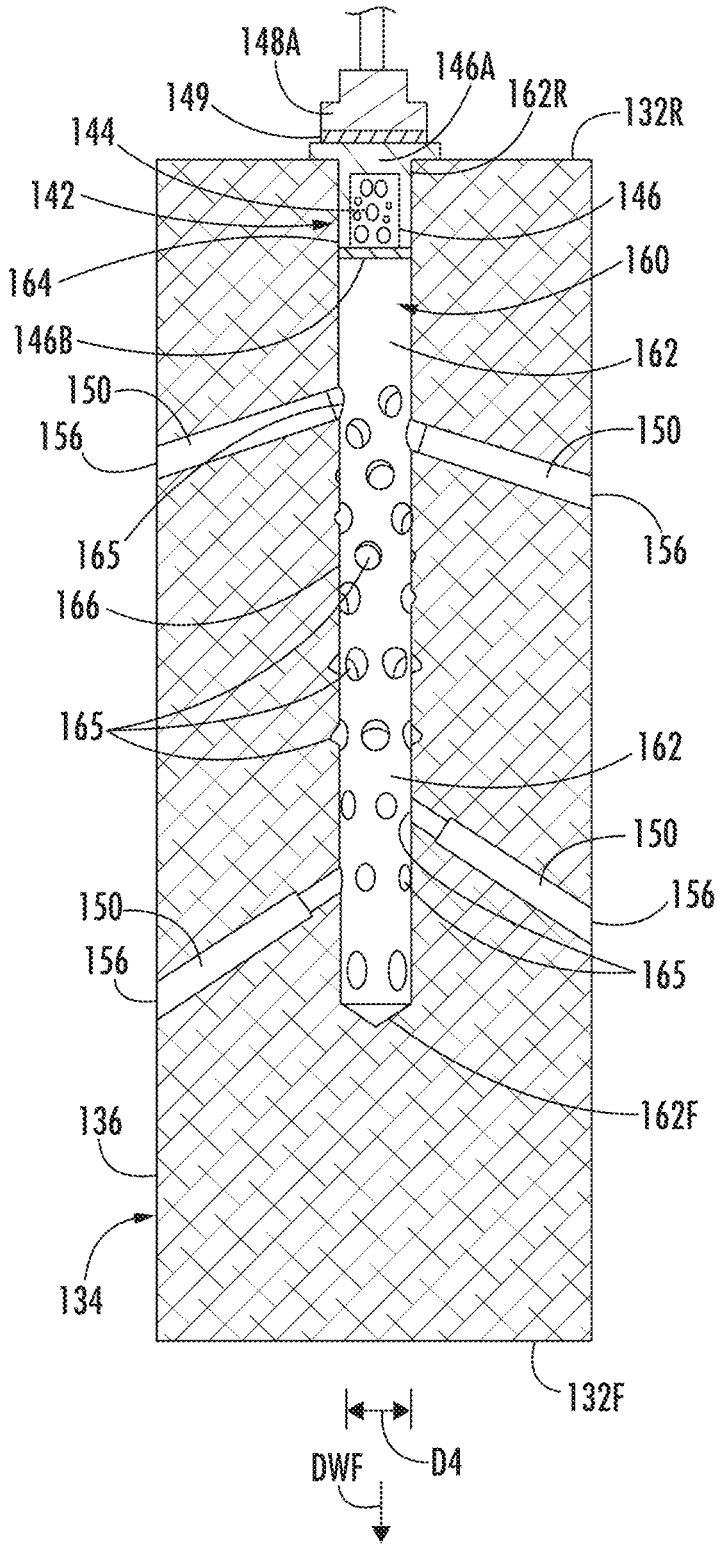
FIG. 15 is a cross-sectional view of the warhead of FIG. 13 taken along the line 15-15 of FIG. 13.

With reference to FIG. 15, the pressure delivery system 160 includes a pressure distribution chamber or manifold 162, a plurality of distribution ports 165, and a plurality of pressure delivery conduits or passages 167 defined in the warhead body 134. The manifold 162 has a rear end 162R and an opposing front end 162F. The manifold 162 includes an entrance section 164 and an entrance opening 164A (adjacent the rear end 162R) and a main section 166 (adjacent the front end 162F).

In some embodiments, the manifold 162 is substantially cylindrical. In some embodiments, the manifold 162 has an inner diameter D4 (FIG. 15) in the range of from about 9 mm to 55 cm, and a volume in the range of from about 30 cc to 450 cc.

The gas generation system 140 includes a gas generator 142 and a gas generator actuation system 148. In use, the gas generator 142 is operable, when actuated, to rapidly produce, output, or generate a high temperature, high pressure gas that serves to pressurize the manifold 162 and drive, displace or propel the projectiles 170 through their barrels 150. The gas generator actuation system 148 is configured and operable to actuate the gas generator 142 (to generate the high-pressure gas) when the gas generator actuation system 148 is triggered (e.g., by the fuze 118). In some embodiments, the gas generator actuation system 148 includes a fire train. The gas generator actuation system 148 may be partially or fully integrated into the component(s)

forming the gas generator 142. In some embodiments, the gas generator 142 is a self-contained or modular device.

The gas generator 142 includes a gas generating material 144 (FIG. 15). In some embodiments, the gas generating material 144 is a combustible gas generating material. In some embodiments, the combustible gas generating material 144 is held and contained in a hollow can, housing or container 146.

One end 146B of the gas generator container 146 is designed to burst and release the product gases of the reactive gas generator into the manifold 162. The other end 146A of the gas generator container 146 is a bulkhead design to withstand the pressures without failure. The gas generator 142 is installed into the open end of the manifold 162 with the bursting end 146B facing into the manifold 162. The opening of the manifold 162 and the container 146 may each be threaded for attachment of the gas generator 142 to the warhead body 134. The container 146 may be formed of steel, for example.

In some embodiments, the combustible gas generating material 144 is an explosive material. The explosive material 144 may be any suitable explosive material. When activated, the explosive material 144 is converted to gaseous products by explosive chemical reactions and the energy released by those reactions.

In some embodiments, the gas generating material is an explosive in granular or pellet form. The gas generating granules are contained but not tightly confined.

The gas generator container 146 may also contain wadding that limits the motion of the gas generating granules 144, but does not tightly confine the gas generating explosive granules 144. This loose packing can serve to prevent a deflagration of the explosive material 144 that is too rapid, or even detonation of the explosive material 144, which might result from tight confinement of the explosive material 144.

In some embodiments, the explosive material 144 includes a condensed liquid or solid material or propellant.

In some embodiments, the gas generator explosive material 144 is a charge of a low explosive (LE) material. A low explosive is a chemical mixture that deflagrates. That is, the low explosive material explodes in the form of subsonic combustion propagating through heat transfer, with hot burning low explosive material heating the next layer of the cold low explosive material and igniting it. The exploding low explosive changes into gas by rapidly burning or combusting without generating a high-pressure wave as generated by detonation of a high explosive. The rate of combustion of a low explosive is less than 632 meters/second. In contrast, a high explosive (HE) as deployed in a typical warhead detonates. In detonation, the front of the chemical reaction propagates through the HE material supersonically.

In some embodiments, the LE charge 144 is a combustible powder propellant. In some embodiments, the LE charge 144 is a smokeless powder (e.g., nitrocellulose based)

In some embodiments, the explosive material 144 is or includes a "Hi-Temp" composition, such as a combination of nitramine, nitrocellose, and plasticizer/binder.

In some embodiments, the explosive material 144 is or includes HTPB-Ammonium perchlorate grains/pellets.

In some embodiments, the explosive material 144 is or includes boron potassium nitrate ($BKNO_3$).

In some embodiments, the gas generator explosive material 144 is or includes a reactive material typically characterized or referred to as high explosive (HE). However, in the configuration and implementation of the warhead 130, the HE material used for the material 144 is not detonated. Rather, the reaction of the HE material is controlled or limited (e.g., by the loose packing described above) to induce deflagration of the HE material and prevent detonation of the HE material.

The gas generator actuation system 148 can be configured and operated to actuate the gas generator 142 using any suitable technique. The warhead 130 may include an adaptor that enables attachment of a commercially available munition initiator to the gas generator 142.

In some embodiments, the gas generator actuation system 148 includes a shock initiation device 148A (FIGS. 6, 10, 14 and 15) that is operated to initiate combustion of the material 144. In some embodiments, the shock initiation device 148A is a Low Energy Exploding Foil Initiator (LEEFI) (e.g., an RSI-2220 LEEFI). The gas generator container 146 may also contain a small amount (10 to 100 mg) of secondary explosive that aids in shock initiation of the gas generating material 144.

In use, when gas generation is desired to propel the projectiles 170, the shock initiation device 148A is triggered (e.g., by the fuze 118) to generates material shockwaves in the bulkhead end 146A of the gas generator container 146. These shockwaves are transmitted to the gas generating material 144 directly, producing initiation, or transmitted to the small secondary explosive booster that detonates and initiates combustion of the gas generating material 144. In this case, it is important that the shockwave generated by the shock initiation device 148A (e.g., LEEFI) not rupture the outer wall 146A of the container 146. This is referred to as Through-Bulkhead Initiation (TBI). This method of initiation ensures that the pressure is not lost via the path of initiation, but is used to accomplish the desired work. The shock initiation device 148A may or may not be in direct contact with the bulkhead.

The assembly may also include an attenuator member 149 between the shock initiation device 148A and the gas generator container bulkhead end 146A. The attenuator member 149 is configured to reinforce the bulkhead and ensure no pressure is lost even when the gas generator pressure yield is relatively highly energetic. The attenuator member 149 may be a thin plate, a thin metal plate, or a thin stainless steel or titanium plate. In other embodiments employing a shock initiating device 148A, the attenuator member 149 is not provided.

In other embodiments, the gas generator actuation system 148 is or includes a hot wire 148B (FIG. 6) inside the container 146, and the hot wire is used to initiate combustion of the material 144. In use, when gas generation is desired to propel the projectiles 170, the hot wire 148B is supplied (e.g., by the fuze 118) with current sufficient to cause Joule heating sufficient to quickly heat the gas generator material 144 to the point of ignition. The current may by high enough to vaporize the wire. Electrical connections across the bulkhead may allow for connection to the wire 148B.

The gas generator 142 may be a modified version or adaptation of a known or commercially available gas generator. Suitable gas generators for the gas generator 142 may include the 2-103640-1-B gas generator available from PacSci EMC or the RSI-2313 gas generator available from Reynolds Systems, Inc., for example. In other embodiments, the gas generator 142 may be of a customized or unconventional design.

Figure 16:
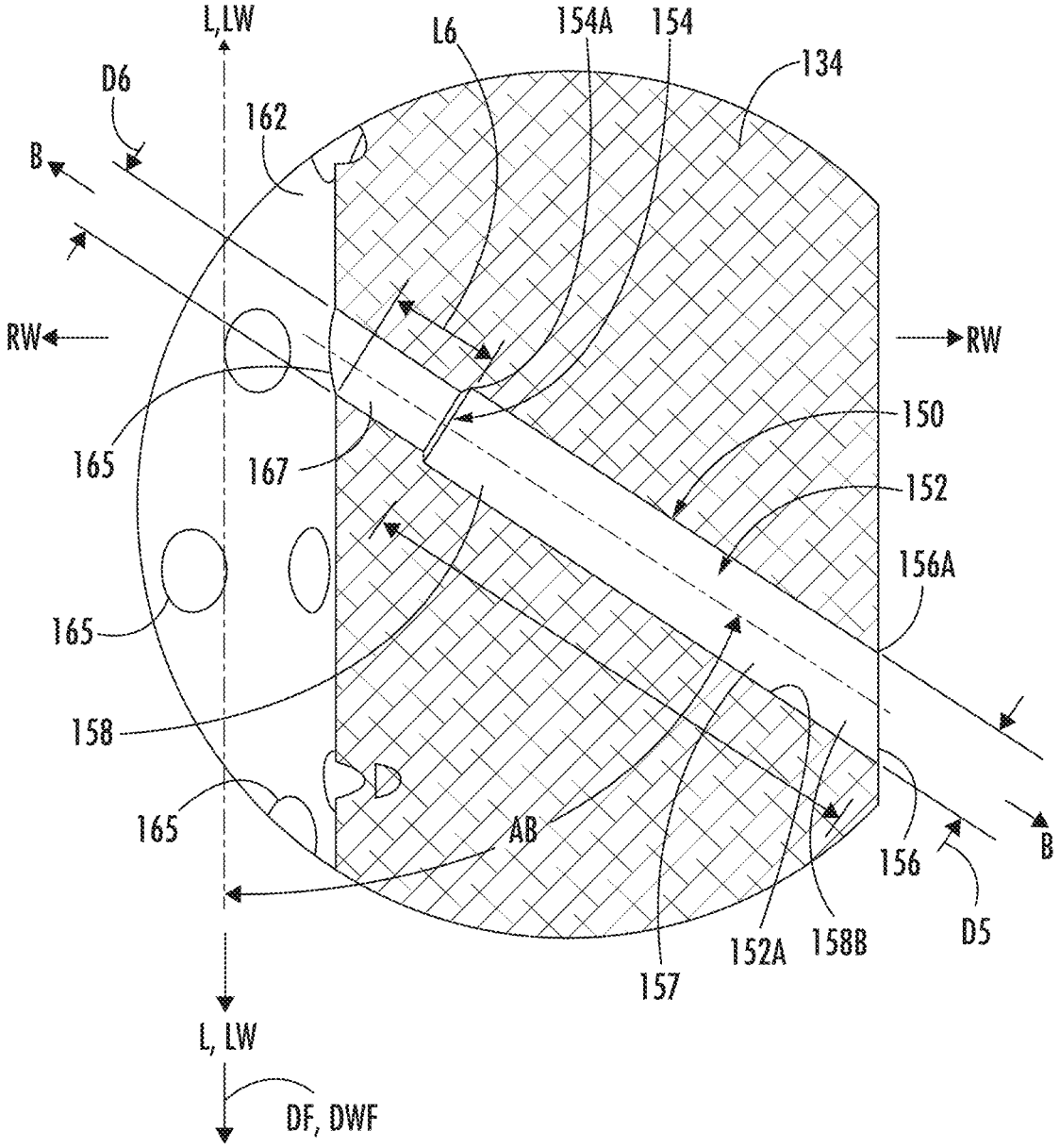
FIG. 16 is an enlarged, fragmentary, cross-sectional view of the warhead of FIG. 13 taken along the line 15-15 of FIG. 13, wherein the projectiles and barrel plugs are not shown.

With reference to FIG. 16, each barrel 150 includes a tubular interior surface 152A defining a barrel lumen, passage, or bore 152. Each bore 152 extends from an inlet opening, orifice, or port 154 (at an entrance end 154A) to an axially opposed exit opening, exit orifice, muzzle opening, or exit port 156 (at an exit end 156A). The inlet port 154 of each barrel 150 interfaces and fluidly communicates with a corresponding one of the pressure delivery passages 167.

Each barrel 150 includes a breech section 158 adjacent the inlet port 154 and in which the projectile(s) 170 are seated until fired. Each barrel 150 also includes a projectile guide section 157 extending from the breech section 158 to the exit port 156. Each barrel 150 defines a barrel axis B-B that corresponds to the axis of travel of the projectile(s) fired through the projectile guide section 157.

The exit ports 156 are axially and circumferentially spaced apart and distributed about the warhead exterior 136 and the warhead axis LW-LW.

In some embodiments, some or all of the pressure delivery passages 167 are configured as gas restriction sections between the manifold 162 and the breech section 158, and thereby between the manifold 162 and the projectiles 170. This restriction meters or regulates the pressure acting on the projectiles to achieve the desired barrel exit velocity. Because it is desirable to have different exit velocities in barrel sets along the length of the warhead (slower near the nose, faster near the tail), the restriction in each barrel or barrel set may be different. In some embodiments, the gas restriction sections 167 are relatively configured such that the exit velocities of the projectiles fired from the barrels 150 near the nose 108 are slower than the exit velocities of the projectiles fired from the barrels 150 near the rear section 104.

In some embodiments, at least some of the barrels 150 have different lengths L5 (FIG. 16) from one another. In some embodiments, the length L5 of each barrel 150 is in the range of from about 2.5 cm to 40 cm.

In some embodiments, the inner diameter D5 (FIG. 16) of each barrel 150 is in the range of from about 6 mm to 10 mm.

In some embodiments, at least some of the pressure delivery passages 167 have different lengths L6 from one another. In some embodiments, each pressure delivery passage 167 has a length L6 is in the range of from about 3 mm to 15 mm.

In some embodiments, the inner diameter D6 (FIG. 16) of each pressure delivery passage 167 is in the range of from about 10% to 95% of the inner diameter D5 of the associated barrel 150.

In some embodiments, the length L6 of each pressure delivery passage 167 is in the range of from about 4% to 70% of the combined length of the associated barrel 150 and the pressure delivery passage 167.

In some embodiments, the warhead includes at least 20 barrels 150. In some embodiments, the number of barrels 150 provided in the warhead body 130 is in the range of from about 20 to 150 barrels.

In some embodiments, at least some of the barrels 150 form a barrel angle AB with the warhead axis LW-LW. That is, the barrel axis B-B of the barrel 150 forms the barrel angle AB (FIG. 16) with the warhead axis LW-LW, and thereby with the forward direction DWF of the warhead 130 and with the direction of travel DF of the warhead 130 in use. The angling of the barrels 150 provides for radial dispersion of the fired projectiles 170.

In some embodiments, at least some of the barrels 150 form an oblique barrel angle AB with the warhead axis LW-LW. In some embodiments, at least some of the barrels 150 form an acute barrel angle AB with the warhead axis LW-LW in the warhead forward direction DWF (i.e., the angle between the barrel axis B-B and the warhead axis LW-LW opening in the forward direction DWF is acute; referred to herein as an acute barrel angle AB).

In some embodiments, a plurality of the barrels 150 form an oblique barrel angle AB with the warhead axis LW-LW. In some embodiments, a plurality of the barrels 150 form an acute barrel angle AB with the warhead axis LW-LW.

In some embodiments, some of the barrels 150 form an acute barrel angle AB and some of the barrels 150 form a perpendicular angle AB with the warhead axis LW-LW.

In some embodiments, at least some of the barrels 150 have different barrel angles AB from one another. In some embodiments, the barrel angles AB vary along the length of the warhead body 134, with higher obliquities near the nose and angles near the tail that are more near normal to the warhead/munition centerline (i.e., the axis LW-LW). In some embodiments, the barrel angles AB are more acute closer to the leading end 132F.

Different warhead embodiments may have a different range of angles based on one or more of: munition terminal velocity; desired region of effect and lethal footprint; projectile exit velocity from the barrel; and desired resultant projectile velocity at the target.

In some embodiments, each barrel angle AB is in the range of from about 25 to 90 degrees.

In some embodiments, each barrel axis B-B intersects the warhead axis LW-LW to form the barrel angle AB. However, in other embodiments, some or all of the barrel axes B-B may be laterally offset from the warhead axis LW-LW so that barrel axis B-B does not intersect the warhead axis LW-LW but forms the barrel angle AB in parallel superimposed planes.

Each barrel 150 is fluidly connected to the manifold 162 by its respective pressure delivery passage 167. More particularly, the inlet port 154 of each barrel 150 is fluidly coupled (via the associated pressure delivery passage 167) to a respective distribution port 165 that interfaces with the manifold 162 at a respective intersection. The distribution ports 165 are axially and circumferentially spaced apart along and about the manifold 162 and the axis LW-LW. When the gas generator 142 is actuated, the manifold 162 distributes the pressurized gas from the gas generator 142 into the barrels 150 through their respective distribution ports 165.

In some embodiments and as shown in FIG. 16, the pressure delivery passage 167 feeding each barrel 150 is coaxial with the barrel 150. This configuration can provide improved manufacturability, fluid flow behavior, and/or packaging. However, in other embodiments, the pressure delivery passage 167 may be non-coaxial with the barrel 150, replaced with a conduit not forming in the warhead body 134, or omitted altogether. For example, the inlet port 154 of the barrel 150 may be located at the manifold 162 so that the inlet port 154 is the distribution port 165 and the barrel 150 directly intersects the manifold 162.

The barrels 150 may be formed of any suitable material(s). Suitable materials may include, for example, metal or polymer. In some embodiments, the barrels 150 are formed (e.g., by molding, machining or casting) in the housing 134. In some embodiments, the barrel bores 152 are sleeved with a material different from that of the housing 134.

In some embodiments and as illustrated, one or more of the projectiles 170 are positioned in the breech section 158 of each barrel 150. In other embodiments, one or more of the barrels 150 may be plugged and not provided with projectiles 170.

The projectiles 170 may be formed of any suitable material and with any suitable shape or construction. The barrels 150 may contain projectiles of different constructions from one another and/or may contain projectiles with different constructions in the same barrel 150.

Figure 17:
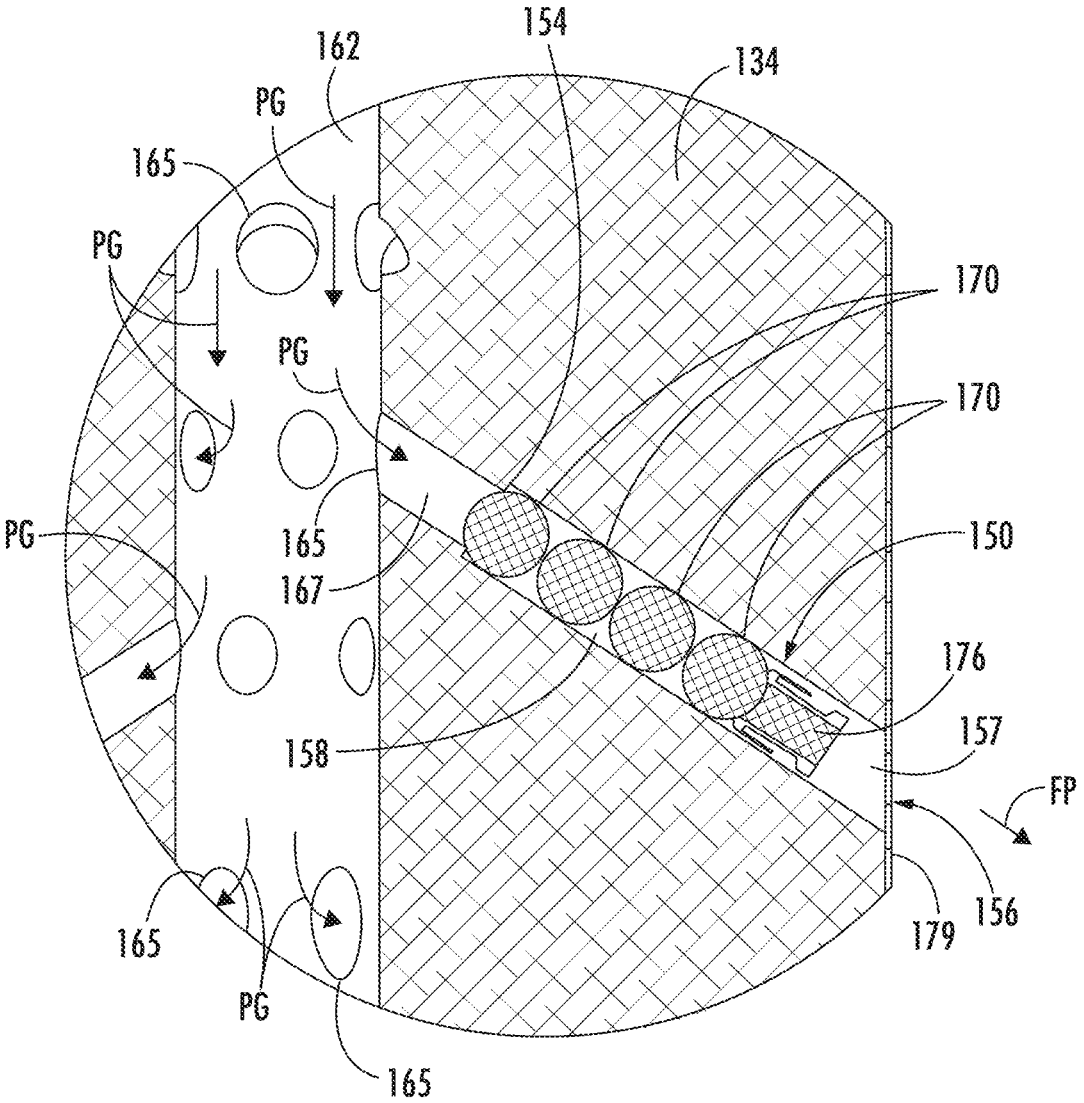
FIG. 17 is an enlarged, fragmentary, cross-sectional view of the warhead of FIG. 13 taken along the line 15-15 of FIG. 13.

In some embodiments, the projectiles 170 are spherical (e.g., as shown in FIG. 17).

Figure 18:
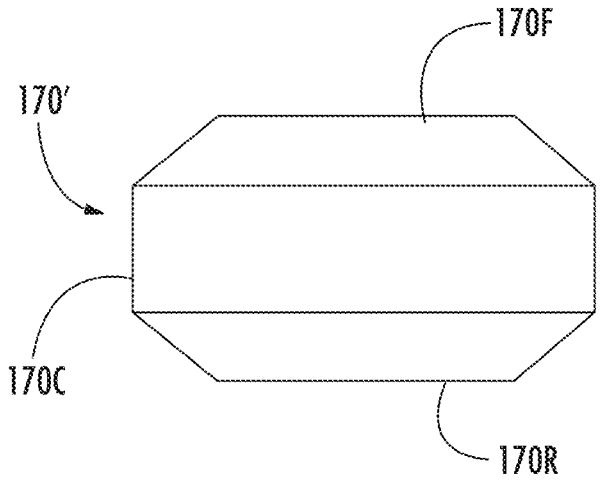
FIG. 18 is a side view of a projectile according to an alternative design.
Figure 19:
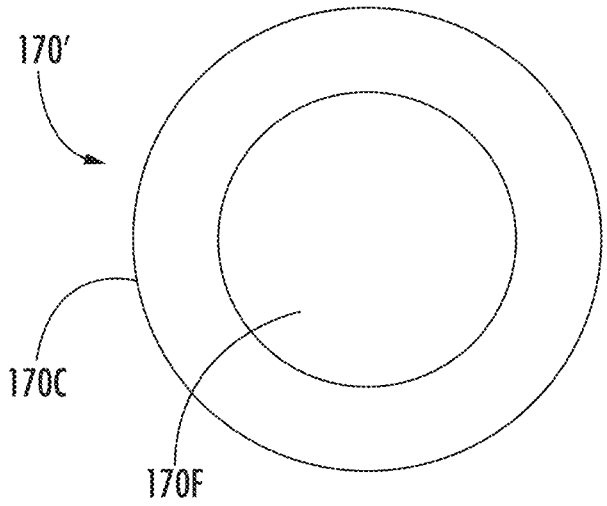
FIG. 19 is a top view of the projectile of FIG. 18.

In some embodiments and as illustrated in FIG. 17, the projectiles 170 are cylindrical or disc-shaped. For example, a projectile 170' as shown in FIGS. 18 and 19 has a substantially planar front face 170F, an opposing substantially planar rear face 170R and a cylindrical circumferential sidewall 170C. The transitions from the faces 170F, 170R may be substantially frustoconical as shown, for example.

In some embodiments, the projectiles 170 are formed of metal, such as steel, lead with gliding metal, or heavy alloys of tungsten, nickel, or iron with densities of 12 g/cc to 17.9 g/cc. In some embodiments, the projectiles 170 are jacketed fragments or slugs. Suitable jacketed projectiles may include a lead core and a copper jacket, for example.

In some embodiments, the projectiles 170 are preformed projectiles. In some embodiments, the projectiles 170 are frangible projectiles.

In some embodiments, the projectiles 170 each have an outer diameter in the range of from about 5 mm to 13 mm.

In some embodiments, the projectiles 170 each have a mass in the range of from about 0.7 grams to 20.5 grams.

In some embodiments, the total mass of the projectiles 170 in each barrel 150 is in the range of from about 0.7 grams to 200 grams.

Multiple projectiles 170 may be provided in one or more of the barrels 150. In some embodiments, the total number of the projectiles 170 in each barrel 150 is in the range of from 1 to 10.

In some embodiments, the total number of projectiles 170 in the warhead 130 is in the range of from 100 to 1000.

A variety of projectile types could be loaded into a barrel 150. An example would be alternating heavy alloy balls (providing enhanced defeat of body armor and light cover) and lead disks (to provide maximum tissue damage). Low angle barrels may contain heavy alloy balls to provide penetration while higher angle barrels might contain frangible projectiles. High angle projectiles are more likely to impact surrounding structure and ground surfaces at high angles of obliquity (off normal), and therefore more likely to ricochet with collateral risk.

The projectiles 170 are installed in the barrel 150 when the warhead is manufactured. The projectiles 170 are restrained in each breech section 158 by a reduction in bore in the direction of the manifold 162 and by a respective retainer plug 176 in the direction of the muzzle 156. The retainer plugs 176 may be formed of plastic.

The barrels 150 may have a smooth bore that provides for a tight sliding fit of the projectiles 170. In some embodiments, the barrel diameter D5 is between 0.001 inch and 0.010 inch larger than the diameter of the projectiles 170 in the barrel 150.

In some embodiments, the warhead 130 also includes one or more components over and/or in the barrel exit ports 156. In this case, the barrels 150 and ports 156 may not be visible external of the munition 100. The covering may include port plugs 178 (FIG. 14) that are inserted into the barrel exit ports (muzzles) 156. The covering may include a cover or sheath 179 (FIGS. 13 and 14) that surrounds the warhead body 134 and covers the barrel exit ports 156. The warhead 130 may include both port plugs 178 and a sheath 179.

The cover(s) 178, 179 may be used to provide a smooth exterior and ensure low aerodynamic drag, reduce weapon audible signature, prevent foreign objects from entering the barrels, and/or provide environmental protection.

The plugs 178 or cover 179 may be attached with adhesive. In some embodiments, the cover(s) 178, 179 are formed of a polymer. Suitable polymers may include thin high-density polyethylene (HDPE), ABS, Kapton, or Nylon 6/6, for example.

The munition system 10 and the munition 100 may be used as follows in accordance with some embodiments.

Initially, the munition 100 is suitably prepared or armed. This may be executed in known manner, for example.

The munition 100 is launched and transits toward the target E. The munition 100 may fly to the vicinity of the target under the power of the propulsion system 104B. The flight of the munition 100 may be navigated using the guidance system 112, the targeting detection system 116, and/or commands from the remote controller 12 received via the communications transceiver 114. According to some embodiments, the munition 100 will thereafter execute the steps described below automatically and programmatically.

Once the munition 100 reaches the vicinity of the target E, the munition 100 is triggered to fire.

In some embodiments, the warhead 130 is triggered to fire by the HOB sensor 115. In flight, the HOB sensor 115 will monitor the altitude of the munition 100. When the HOB sensor 115 detects that the munition has reached a prescribed altitude (e.g., 10 feet above ground), the HOB sensor 115 will generate a corresponding trigger signal to the controller circuit 101 of the fuze 118. Responsive to receipt of the trigger signal, the fuze 118 actuates the gas generator actuation system 120 to explode (deflagrate) the explosive 144. The warhead 130 is thereby fired.

In some embodiments, the target E is detected by the target detection system 116 and the trigger sequence is initiated by a signal to the fuze 118 from the target detection system 116. The fuze 118 may take one or more of the terminal conditions of the munition 100 (e.g., height above target, velocity, or angle of approach) as inputs, and from this determine when to initiate actuation of the gas generator 142. In some embodiments, the trigger sequence in initiated automatically and programmatically and each of the steps from trigger sequence initiation to firing are executed automatically without additional human input.

Responsive to being triggered as described above, the fuze 118 causes the gas generator actuation system 148 to actuate the gas generator 142. As described above, in some embodiments the fuze 118 sends a firing initiation signal to the gas generator actuation system 148 in the form of a high current (from the high voltage supply 119) sufficient to heat a hot wire in the gas generator container 146 or to activate a shock initiating device 148A. However, other techniques for triggering initiation of the gas generation may be used. For example, the fuze 118 may send a first firing initiation signal to an intermediate device that, in response to the first firing initiation signal, generates a current that sufficient to heat the hot wire 148B or trigger the shock initiating device 148A.

Figure 7:
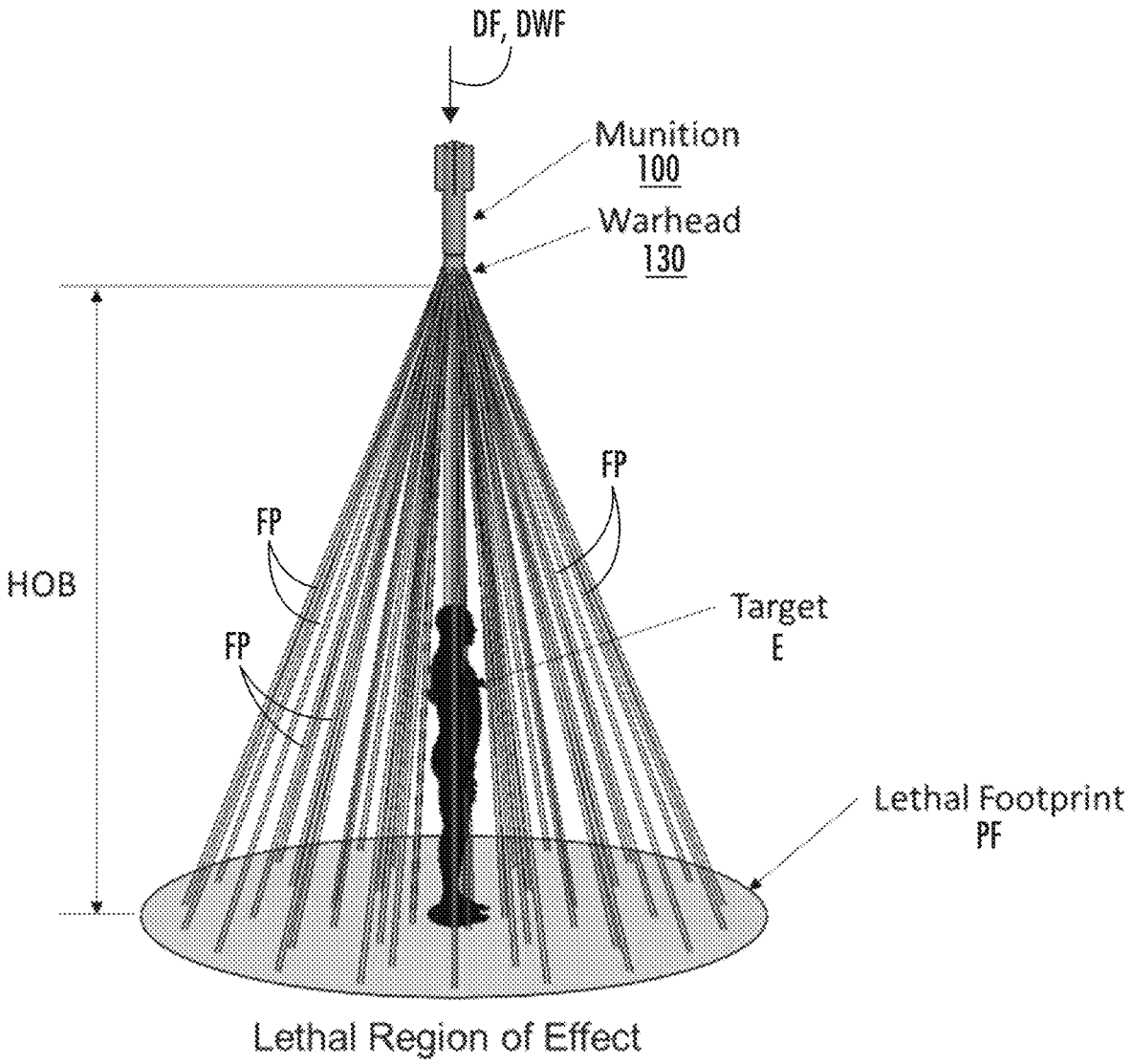
FIG. 7-9 are schematic views illustrating lethal regions of effect of the munition of FIG. 1 when fired under different conditions.

Upon actuation, the gas generator 142 generates a quantity of a propulsion gas PG (FIG. 17) having a relatively high gas pressure that drives or projects the projectiles 170 outward from the warhead 130 through the respective barrel bores 152 and exit ports 156 with high energy. The propulsion gas PG pressurizes the barrel bores 152 via the manifold 162. More particularly, the propulsion gas PG flows sequentially out through the burstable end 148B of the gas generator 142, through the manifold 162, through the distribution ports 165, through the pressurized gas delivery passages 167, through the inlet ports 154, through the barrels 150, and through the exit ports 156. This gas pressure and resulting propulsion gas PG flow drives the projectiles in respective outward firing directions FP (FIGS. 1, 7, and 17).

In some embodiments, the propulsion gas PG pressurizes the barrel bores 152 via the manifold 162 substantially simultaneously. In some embodiments, the projectiles 170 each exit their respective exit ports 156 at the same time or within less than 50 milliseconds apart.

In the case of a LE charge gas generator 142, the LE explosive material 144 deflagrates, thereby generating the pressurized propulsion gas PG as a product of the deflagration.

In the case of a gas generator 142 including a HE explosive material 144, the HE explosive material 144 likewise deflagrates because the warhead 130 is not configured or operated to initiate detonation of the HE explosive material. The deflagrating HE explosive material 144 thereby generates the pressurized propulsion gas as a product of the deflagration.

In some embodiments, the maximum pressure of the pressurized gas PG in the barrel 150 is in the range of from about 10,000 psi to 35,000 psi.

In some embodiments, the terminal velocity of the munition 100 relative to the target E at munition impact is in the range of from about 150 m/s to 340 m/s.

In some embodiments, the muzzle or exit velocity of each projectile 170 relative to its associated exit port 156 (i.e., from the barrel 150) is in the range of from about 40 m/s to 250 m/s. Barrel exit velocities may be varied to expand or contract the area and distance of projectile impact.

In some embodiments, the impact velocity of each projectile 170 relative to the target E at projectile impact is in the range of from about 225 m/s to 500 m/s. Velocity of projectiles impacting target is a resultant of the barrel exit velocities and the munitions terminal velocity.

Because no HE explosive material is detonated in the warhead 130, the dispersion of the warhead 130 is substantially limited to expulsion of the projectiles 170 and the propulsion gas PG.

The projectiles 170 are projected in a forward (in direction DF) focused projection pattern PF (FIG. 7). In some embodiments, the forward focused projection pattern PF extends about 360 degrees circumferentially about the warhead axis LW-LW. The projection pattern PF may be a substantially frusto-conically shaped pattern. In some embodiment, the dispersion is generally a cone shape. The effect is an area of projectile impact in an expanding circular area normal to the longitudinal axis L-L of the munition.

The projectile material, geometry, and velocity can be adapted to provide lethal effects to personnel in the open, with and without body armor, and personnel behind light cover. Examples of light cover include unarmored vehicles (cars, trucks, box trucks), corrugated metal roofing, sheet rock, commercial and residential windows and doors. The projectile pattern density may produce multiple impacts on individuals inside the region of effect.

As described above, a fuze scheme may used for warhead initiation a predefined distance above/from a target or ground plane (i.e., a height-of-burst (HOB) scheme, where the distance above/from a target is the HOB distance). The warhead 130 can be configured to account for this HOB to provide the desired region of effect. HOB, terminal angle, and terminal velocity may be be accounted for when defining the region of effect.

Figure 8:
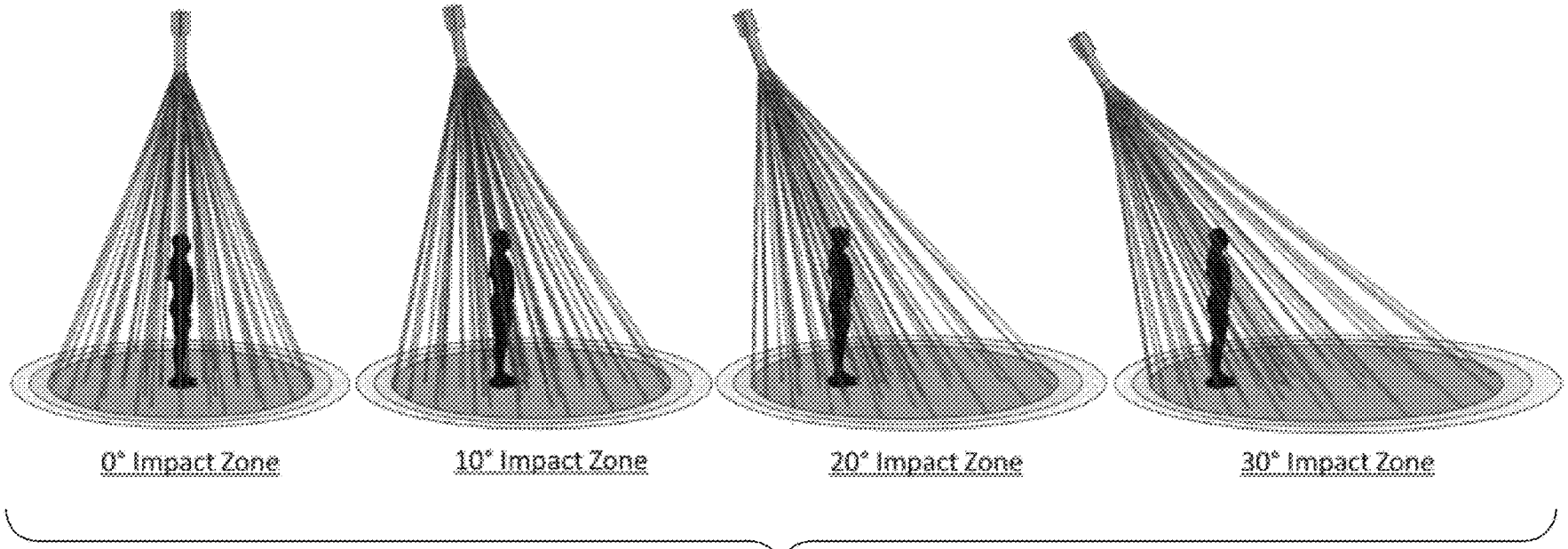
Figure 9:
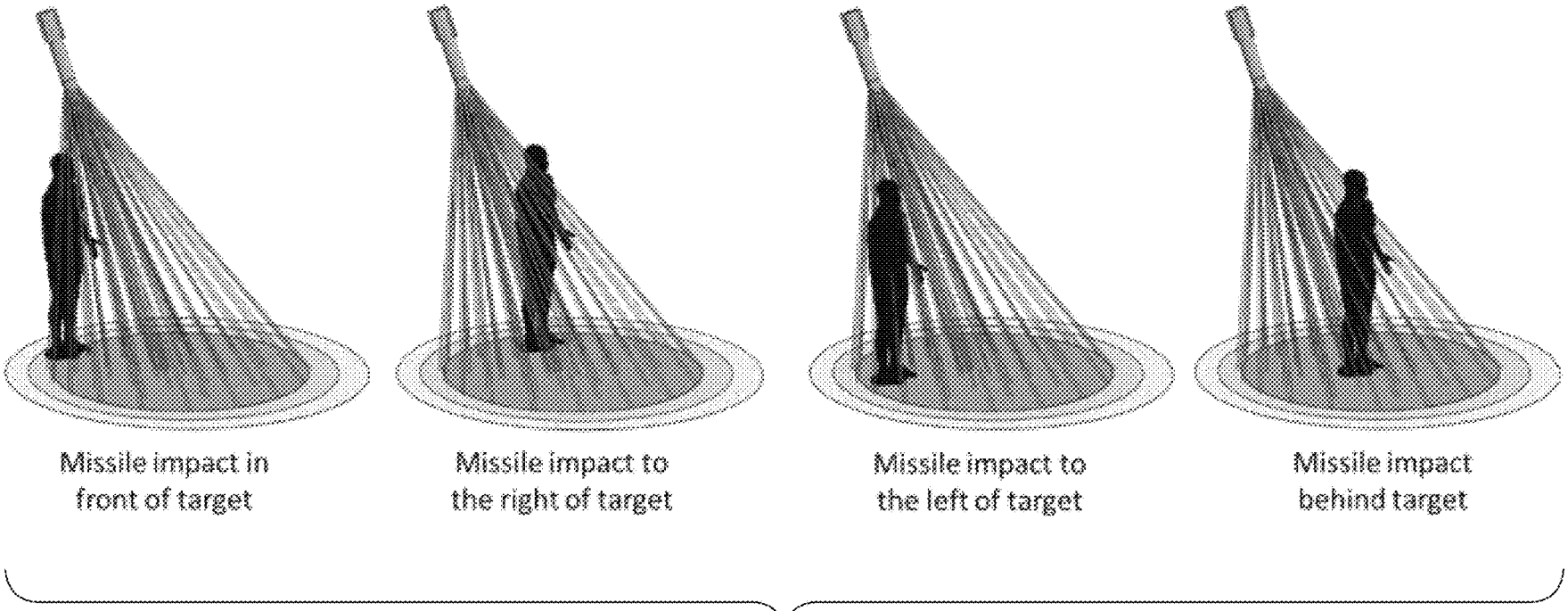
Figure 10:
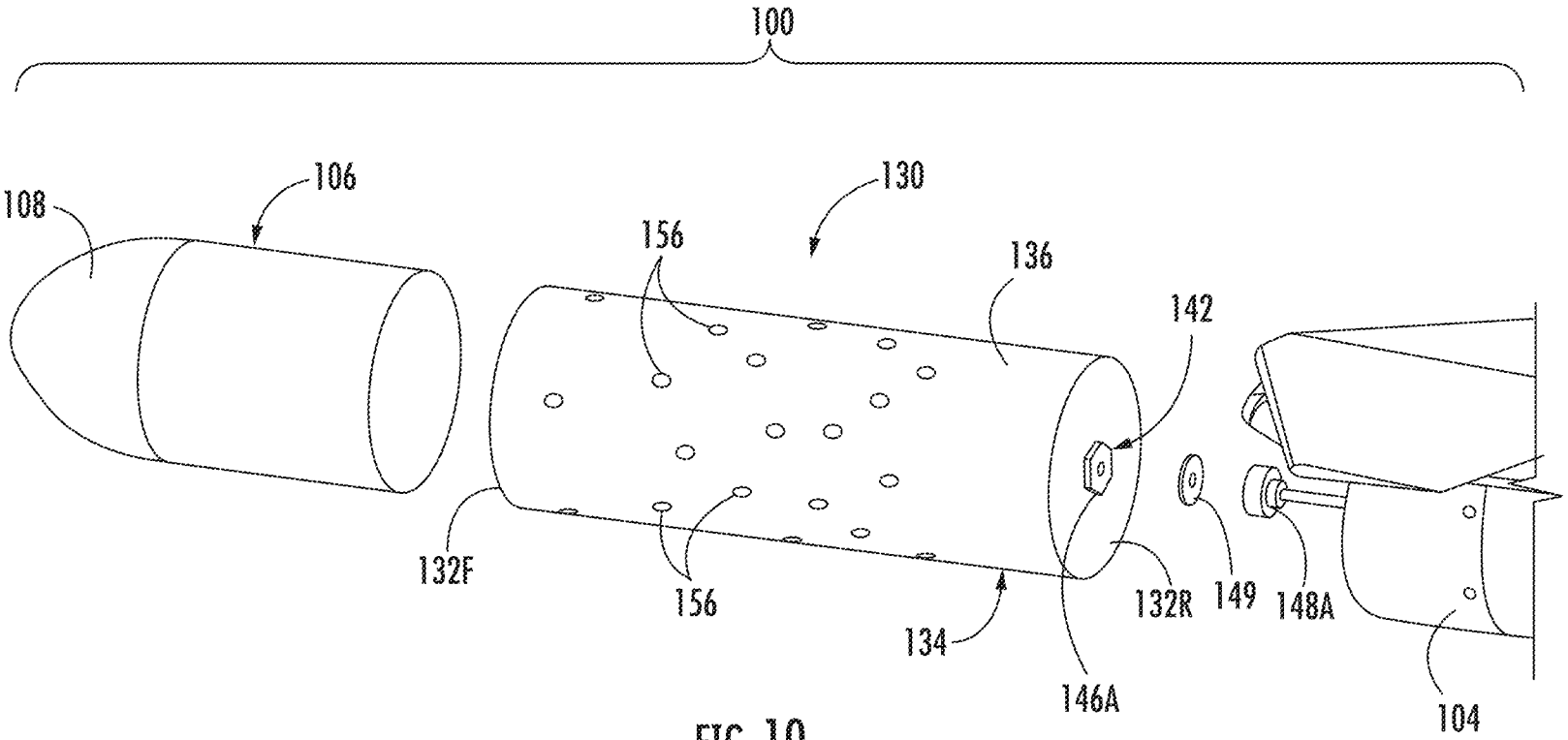
FIG. 10 is a fragmentary, exploded, perspective view of the munition of FIG. 1.
Figure 12:
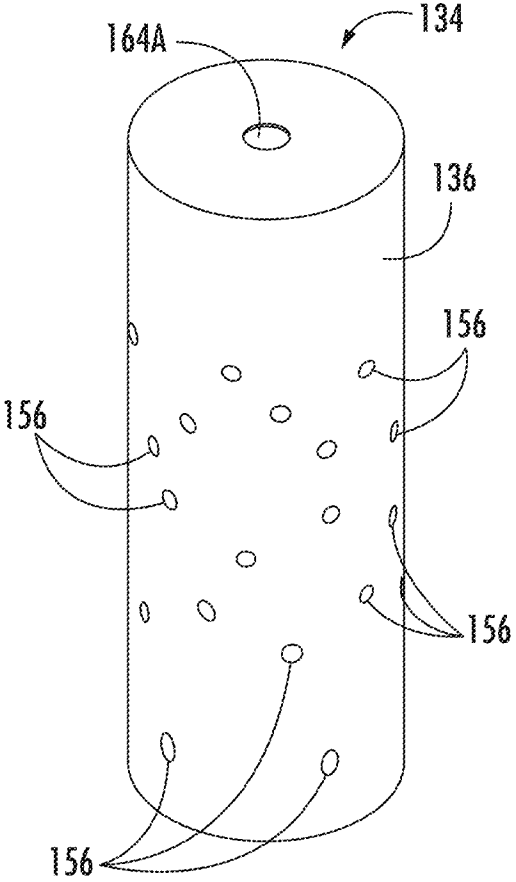
FIG. 12 is a rear perspective view of the warhead body of FIG. 11.
Figure 11:
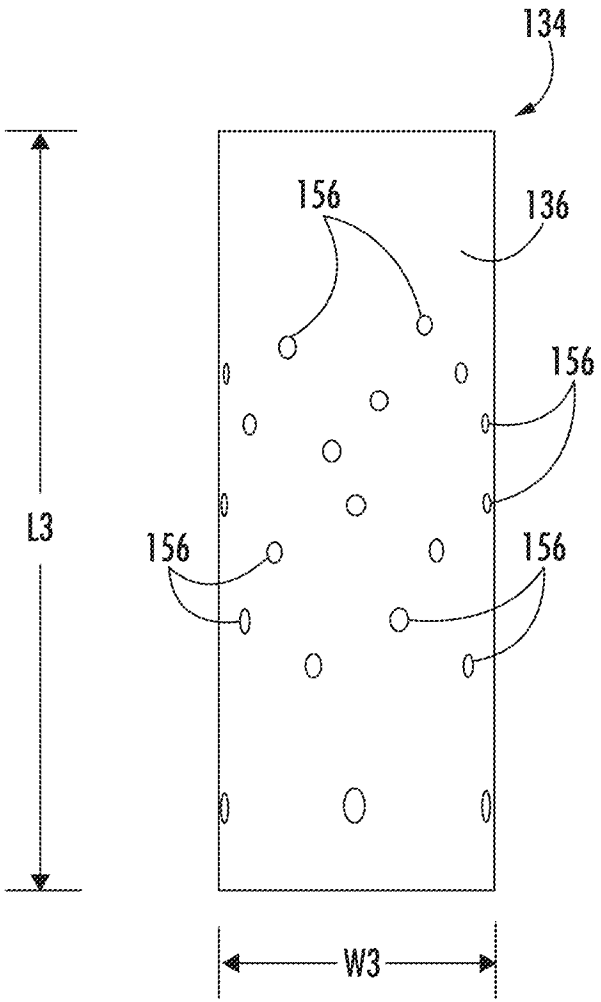
FIG. 11 is a side view of a warhead body forming a part of a warhead according to some embodiments and forming a part of the munition of FIG. 1.
Figure 13:
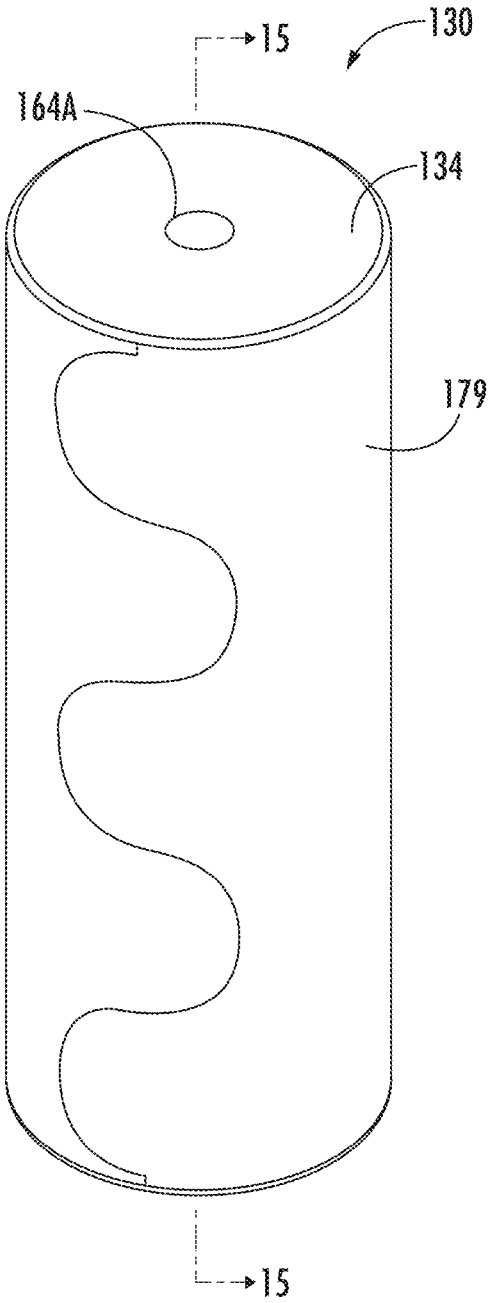
FIG. 13 is a fragmentary, rear perspective view of the warhead of the munition of FIG. 1.

The warhead 130 may be configured such that, in operation, the warhead 130 fires a spray of projectiles 170 in a tight pattern from an array of barrels 150. The projectiles 170 traverse a cone volume emanating from the warhead 130. Examples of projectile dispersion are illustrated in FIGS. 7-9. The munition 100 (including the warhead body 134) will traverse the center of the cone and act as a large lethal fragment. The munition 100 and the projectiles 170 from a number barrels 150 near the front of the warhead 130 act together to provide ensured lethality near the center of the region of effect, eliminating the "cone-of-life" phenomenon that is common for existing munition/warhead systems. FIG. 7 illustrates a lethal region of effect for the warhead 130 when the warhead 130 is fired in a flight direction normal to the ground. FIG. 8 illustrates lethal regions of effect for the warhead 130 when the warhead 130 is fired in a flight direction off-normal to the ground. FIG. 9 illustrates lethal regions of effect for the warhead 130 when the warhead 130 is fired in a flight direction offset from the target.

Figure 20:
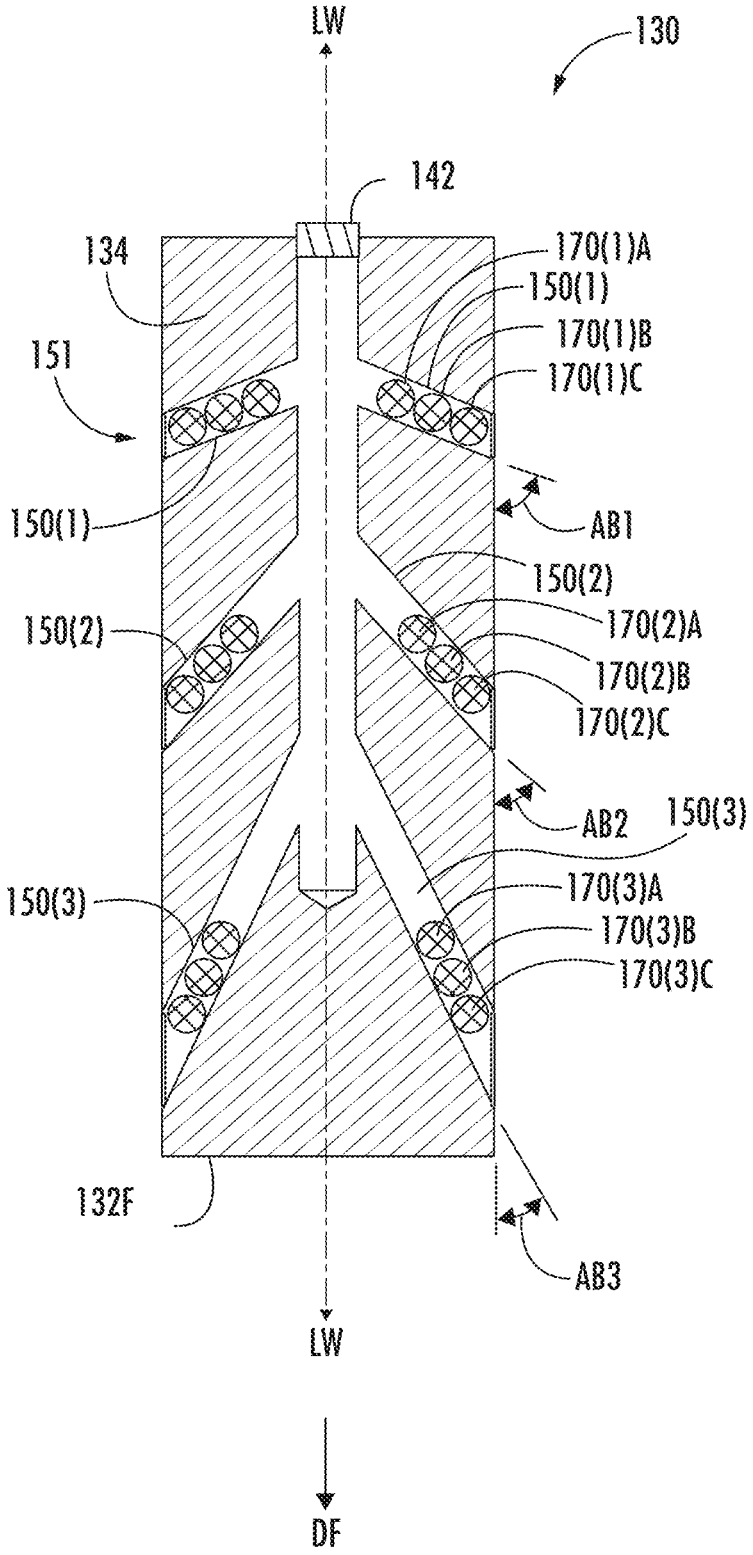
FIG. 20 is a schematic, cross-sectional view of the warhead of FIG. 13 illustrating an array of barrels of the warhead having different barrel angles.
Figure 21:
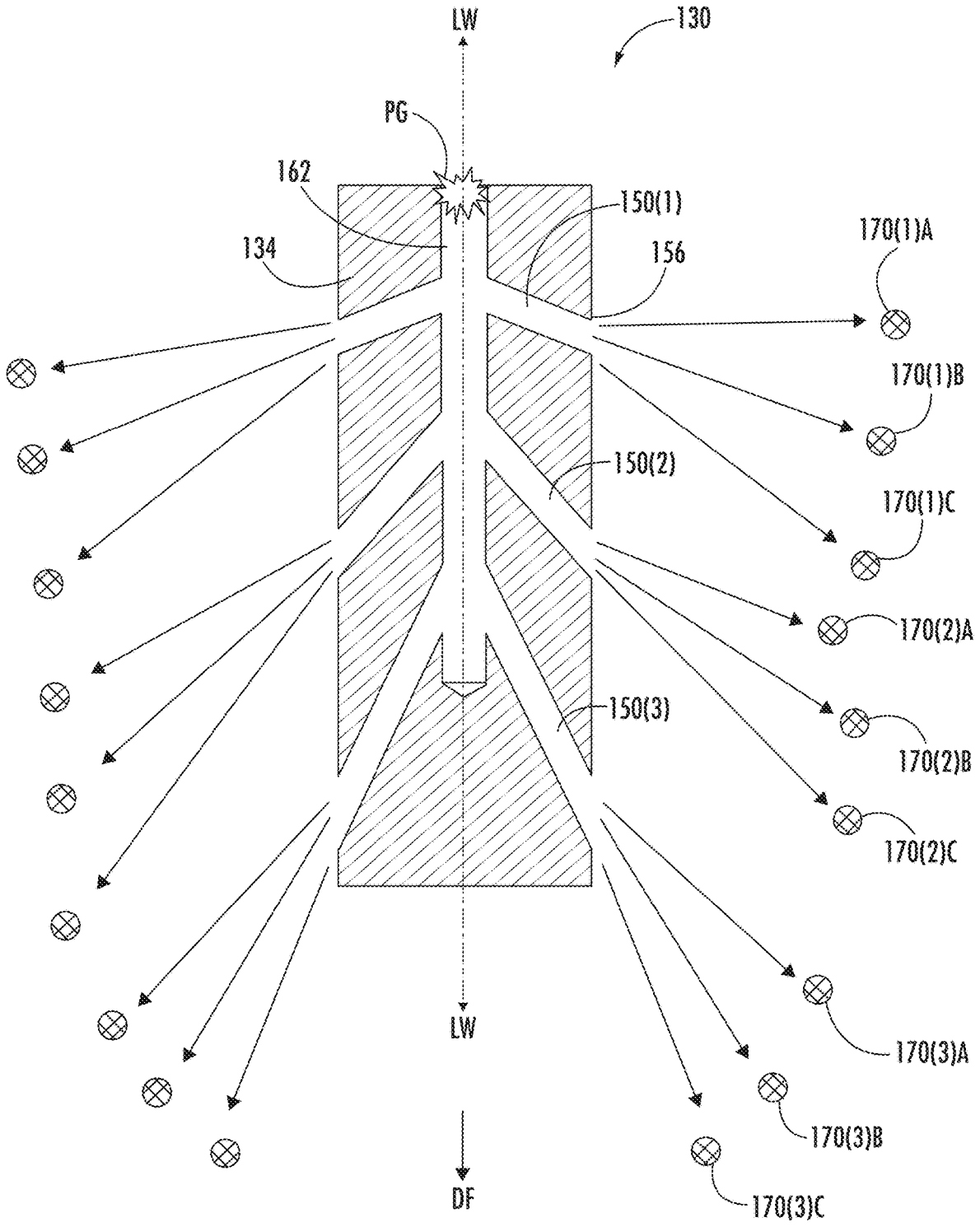
FIG. 21 is a schematic, cross-sectional view of the warhead of FIG. 20 illustrating ejection of the projectiles from the array of barrels when the gas generator is actuated and the warhead is traveling in a forward direction.
Figure 22:
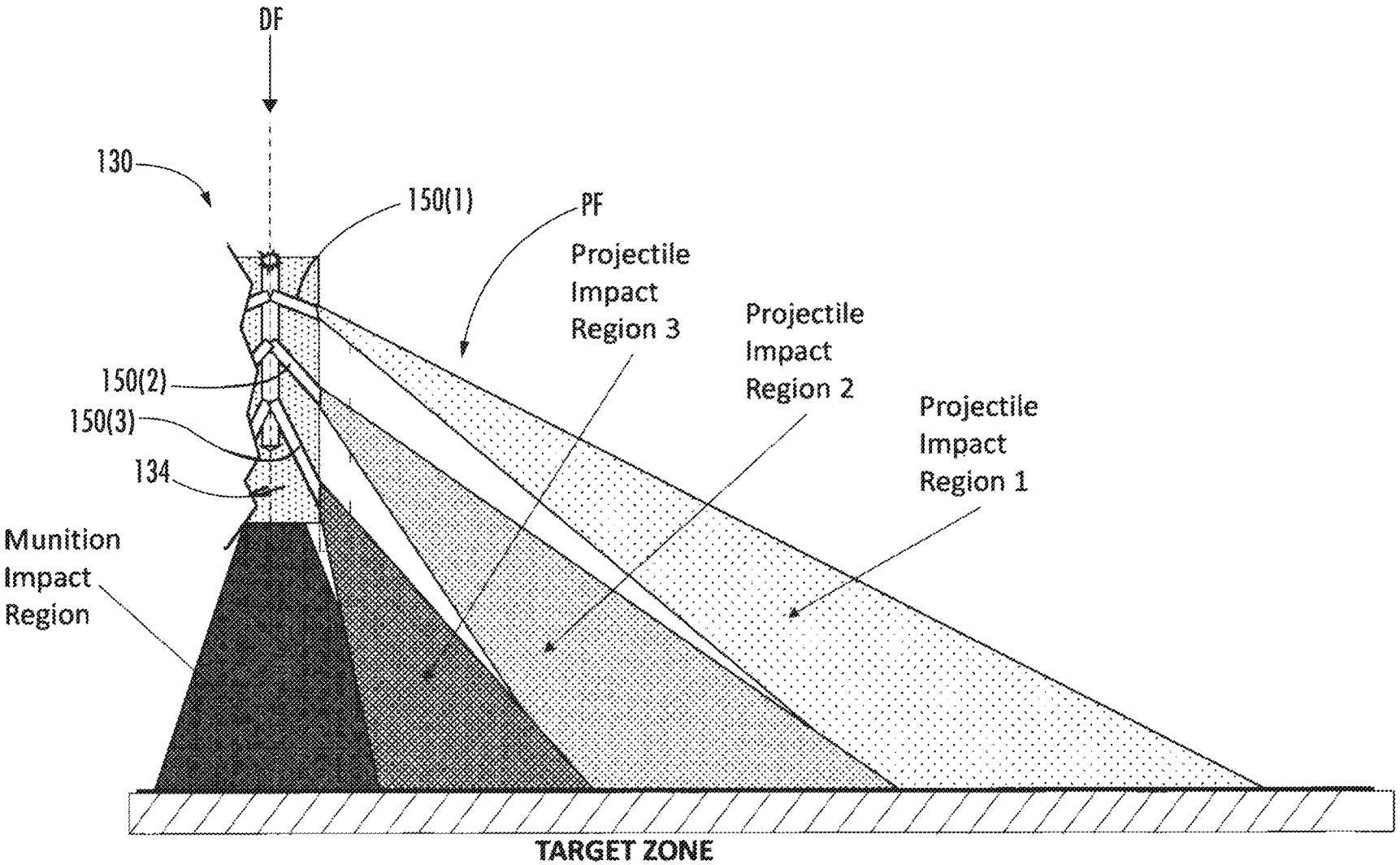
FIG. 22 is a schematic, cross-sectional view of the warhead of FIG. 20 illustrating regions and distribution of impact of the fired projectiles.

As discussed above, in some embodiments the barrel angles (i.e., the orientations of the barrels relative to the warhead axis LW-LW and the warhead forward direction of travel DF) may be varied along the length of the warhead. FIGS. 20-22 schematically illustrate a warhead 130 configuration or architecture including an array 151 of barrels 150(1), 150(2), and 150(3). Referring to FIG. 20, the barrels 150(1), 150(2), and 150(3) have barrel angles AB1, AB2, and AB3, respectively. The barrel angles AB1, AB2, and AB3 are different from another. The barrel angle AB2 is less than the barrel angle AB1 (i.e., the barrel 150(2) is angled more steeply forward than the barrel 150(1)), and the barrel angle AB3 is less than the barrel angle AB2. Three projectiles 170(1)A-C are contained in each barrel 150(1); three projectiles 170(2)A-C are contained in each barrel 150(2); and three projectiles 170(3)A-C are contained in each barrel 150(3).

As illustrated in FIG. 21, when the warhead 130 is fired while traveling in the forward direction DF, the projectiles 170 are distributed in accordance with the angle of their barrel 150 and their position in the barrel. The projectiles of differently angled barrels are projected at different angles to the warhead body 134 and its forward motion DF. The projectiles 170 fired from barrels having a greater barrel angle (e.g., the projectiles 170(1)A-C) are projected radially farther from the warhead body 134 than the projectiles 170 fired from barrels having a lesser barrel angle (e.g., the projectiles 170(3)A-C).

Additionally, the projectiles 170 nearer the exit port 156 of a barrel are ejected prior to the more inward projectiles. As a result, the projectiles from a given barrel are radially dispersed in the projection pattern PF. For example, in the illustrated embodiment, the projectile 170(1)A is ejected from the barrel 150(1) first, followed by the projectile 170(1)B, followed by the projectile 170(1)C. The projectile 170(1)A may form the outer bound of the Projectile Impact Region 1 (FIG. 22), and the projectile 170(1)C may form the inner bound of the Projectile Impact Region 1, for example.

FIG. 22 illustrates the projection pattern PF that results from the architecture shown in FIGS. 20 and 21. The paths of the fired projectiles 170(1)A-C form the Projectile Impact Region 1, the paths of the fired projectiles 170(2)A-C form the Projectile Impact Region 2, and the paths of the fired projectiles 170(3)A-C form the Projectile Impact Region 3, of the projection pattern PF. As discussed herein, the fully or substantially intact remainder of the munition (including the warhead body 134) also serves as a lethal projectile, and the path of the remainder of the munition forms the Munition Impact Region of the projection pattern PF. The barrel angles AB1, AB2, AB3 may be chosen to provide the desired regions of effect, while also accounting for the munition velocity, projectile barrel exit velocity, and HOB.

The barrel orientation and projectile velocity can be engineered tailored to deliver the projectiles 170 with lethal energy to a target. The projectile dispersal pattern, and the region of effect produced, accounts for the expected munition terminal angle and velocity vector of the munitions. The region of effect may be a requirement that goes into the design of the of the warhead and that is supplied by end-users and military stakeholders. Regions of effect for this warhead may be generally define by a cone having the munition at the vertex and a base at the ground plane. The height of the cone is the nominal HOB and the base radius is taken as a design input.

The number of projectiles 170 in the warhead 130 may range from 100 to 1000, scaling with the size of the munition and the desired volume of the region of effect.

The munition 100 can provide a number of advantages over known projectile munitions. The munition 100 provides for precision attack (forward focused projection).

The warhead 130 can be constructed as a single, integrated, modular assembly that can be simply attached and connected to other components of the munition. The housing 134 provides load structural carrying capacity with minimal parasitic mass/volume. External housings or fairings are not necessary. The housing 134 conforms to exterior shape (OML) of munition. The warhead 130 can be configured as a "drop-in" replacement for existing warheads so that existing munition designs can be repurposed or retrofitted with the warhead 130. The warhead 130 is scalable, and could be sized to fit into missile systems of different types and shapes. Warheads according to embodiments of the invention can be constructed to be of near identical weight, volume and center of gravity to the production warheads they are designed to replace.

The warhead body 134 can functionally replace an existing warhead used for a given platform munition, the outer skin of the warhead section (typically load carrying), and any supplemental load carrying components that are part of an existing munition warhead section. Bolt connections for load carrying in any existing warhead section may be duplicated in the warhead body 134.

Initiation of the gas generator 142 may be done with an existing munition warhead initiator, which is typically a LEEFI. The bulkhead end of the gas generator 142 may have threads or a bolt pattern that allows for direct attachment of the existing munition warhead initiator. In some cases, the LEEFI will be integrated into an existing electronic-safe-arm-fire device (ESAD or ESAF). The warhead 130 may directly accept an ESAD with integrated LEEFI, having threads and or a bolt pattern match.

The central cavity or manifold 162 of the warhead body 134 may accommodate a gas generator assembly on the forward (munition nose) end or the aft (munition tail) of the warhead body 134. This can be done to match the location firing mechanisms (ESAD) of existing munition systems so that it is unnecessary to make any changes to signal and power connections to the ESAD.

The design of the warhead 130, including structure and barrel placement, may accommodate munition system wiring that connects components fore and aft. This may be done with internal holes that run between the ends and do not intersect barrels, or external routing in a 'cable tray' (a conduit that has three sides, and the warhead body provides full closure when the tray is installed) that may or may not avoid barrel openings (shooting through cable trays and cables is possible), or using a groove in the warhead body 134 where the cable nest and a cover provides closure.

Projectile delivery can be tailored to a well-defined area having a sharp falloff in density near the boundaries, which provides for precise lethal effects, reductions in collateral damage, and increases warfighter freedom to engage targets. Diameter of the area of effect may be modulated by several methods, including: varying missile height of burst (HOB); varying missile terminal velocity; and/or varying the amount of energy imparted to the projectiles 170 by the gas generator 142.

The projectiles 170 may be fired a range of distances (HOB) above the target or target area, and the munition may have a range of velocities at the time of firing. The effective area of projectile (fragment) impacts will be a function of munition terminal velocity and distance above the ground. Higher distances above the target will result in a larger area of effect, with useful ranges from about 3 ft to 12 ft. Higher terminal velocities of the projectiles will result in smaller areas of effect. Terminal velocities of the projectiles may range from 600 ft/s to 1200 ft/s.

The projectiles 170 can be accelerated via the manifold 162 and travel along the respective barrels 150 out with velocities that are both lethal and cover the engagement area with optimal coverage. In some embodiment, the munition 100 and warhead 130 are configured to provide a substantially circular area of effectiveness having a diameter in the range of from about 8 ft to 16 ft when fired from a height of burst (HOB) in the range of from about 6 ft to 15 ft.

By constraining the projectile dispersion, the munition 100 can execute a precision attack and thereby provide a radically reduced risk of collateral damage (beyond "low collateral damage"). The munition 100 can provide focused attack capability under any engagement conditions and is not dependent on the terminal velocity or angle of attack of the munition.

In some embodiments, the warhead 130 is configured such that the warhead does not disrupt aerodynamic stability.

A munition as disclosed herein can be configured to dispatch projectiles 170 with a relatively even distribution within an identified target circle. The munition design can leverage the platform's engagement velocity (e.g., the velocity and associated kinetic energy of the missile platform 103 carrying the warhead 130) to assist in bringing the projectiles 170 to lethal velocities.

Munitions as disclosed herein can provide first-pass lethality with low risk of collateral damage. Current fragmenting high-explosive (HE) warheads, such as those used on Hellfire or Griffin, carry significant risk of collateral damage and/or friendly fire when engaging high-value targets (HVT). The nature of energy release by HE results in a tendency of projecting lethal fragments radially in a full 360° around the warhead.

Munitions as disclosed herein can be configured as a High Focused Lethality (HFL) warhead that radically reduces collateral damage potential by eliminating the use of detonated high explosives, but will project lethal fragments or projectiles in a tight, forward-projected pattern only, directly at targets under attack, thus increasing target probability of hit ($P_h$) and probability of kill ($P_k$). The warhead may readily integrate into existing precision strike weapon systems.

On a crowded battlefield, for example, there may be a need for munitions with highly precise and lethal effects that do not rely on the indiscriminate reach of HE detonation. Munitions according to embodiments of the invention can incorporate kinetic energy control technologies that eliminate the need for HE charges to project fragments or projectiles. These technologies may provide users with a precision strike munition capability to engage HVTs in areas with a potential for high collateral damage.

The projectile velocity when broken into components is biased toward the direction of the target area. This will limit the projectiles' area of impact, minimizing the collateral damage to those in the area.

Given that no detonated HE is used in the warhead, and the region of effect in intentionally relatively small, the munition or platform itself can be factored into the lethality area (i.e., the missile body itself serves as a "lethal projectile" at the center of the cone) thus reducing the number of fragments needed to ensure a lethal area of influence. The total momentum of the projectiles is small compared to the terminal momentum of the munition, so after warhead initiation and discharge the munition will continue to travel along the centerline of the cone with lethal energy.

The lack of HE detonation can ensure that fragments and the delivery system will remain in a much more predictable and constrained area. The absence of HE allows the munition to remain fully intact, not generating potential lethal debris outside of the region of effect.

The absence of HE allows for the warhead body to be constructed of plastic if desirable for weight savings.

The warhead can be configured and built as a generic warhead that will interface with various different identified weapon systems. While the warhead can be designed to interface with a specific weapon system, designing a warhead that can be easily updated and used on different platforms will be a significant design criterion. The warhead can utilize multiple ports tailored to deliver projectiles in an optimal pattern given the expected engagement angle and speed. Using the identified weapon system platform, the platform's guidance system, and platform's initiation capabilities as design constraints, the resulting warhead may be configured to drive the multiple projectiles to provide expected lethality. The results can be parameterized for adaption to other platforms. Warhead initiation design can be configured to utilize the explosive initiator used by the identified weapon system platform.

Warheads as disclosed herein can be applied to various munitions to achieve various battlefield effects. Warheads according to embodiments of the invention can be incorporated into glide weapons, air-to-ground, as well as air-to-air weapons to decrease collateral damage.

Warheads according to some embodiments of the invention can provide highly lethal first pass effect with a highly defined projectile projection pattern characterized by a steep fall-off in lethal effects at the boundary of the region of effect. The warhead can be configured as a High Focused Lethality (HFL) warhead that radically reduces collateral damage potential by eliminating the use of high explosives, but will project lethal fragments in a tight, forward-projected (relative to the delivery munition) pattern only, directly at targets under attack, thus increasing target probability of hit ($P_h$) and probability of kill ($P_k$). The warhead may readily integrate into existing and future precision strike weapon systems.

Figure 23:
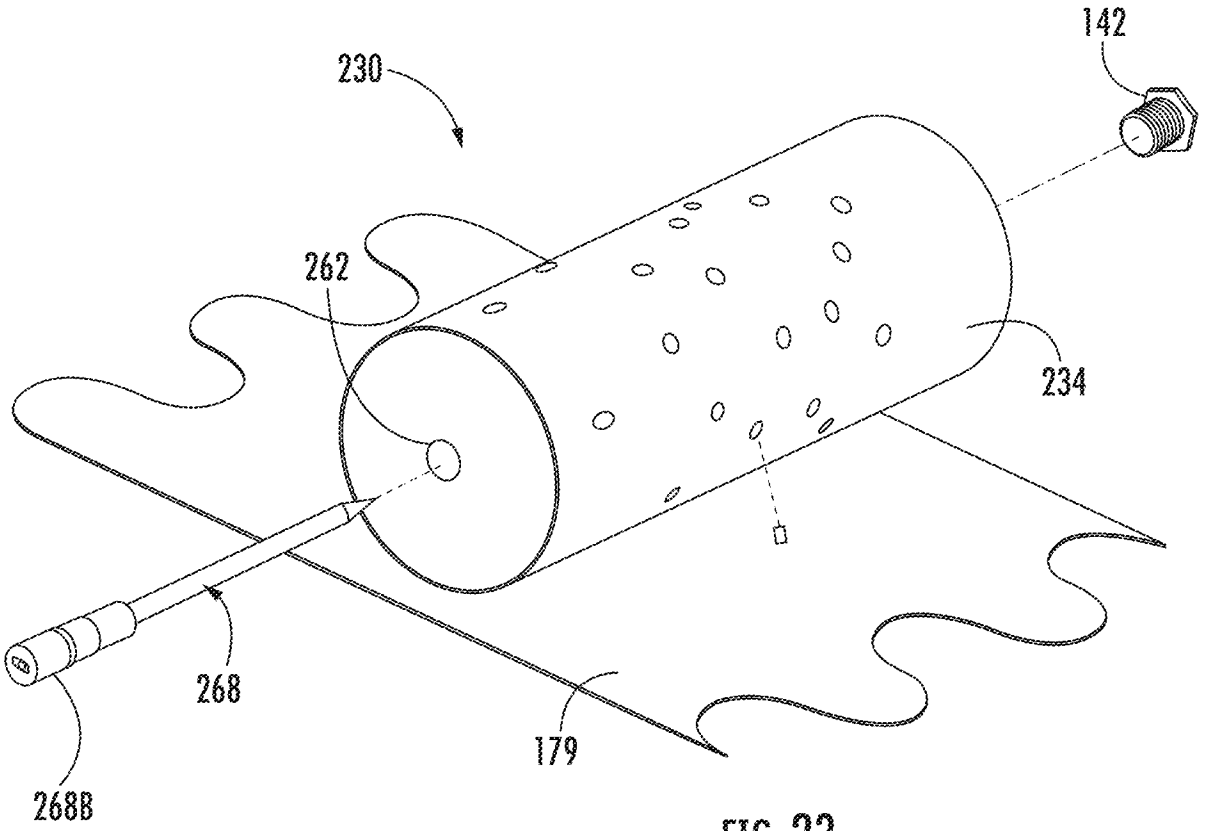
FIG. 23 is an exploded, front perspective view of a warhead according to a further embodiment.
Figure 24:
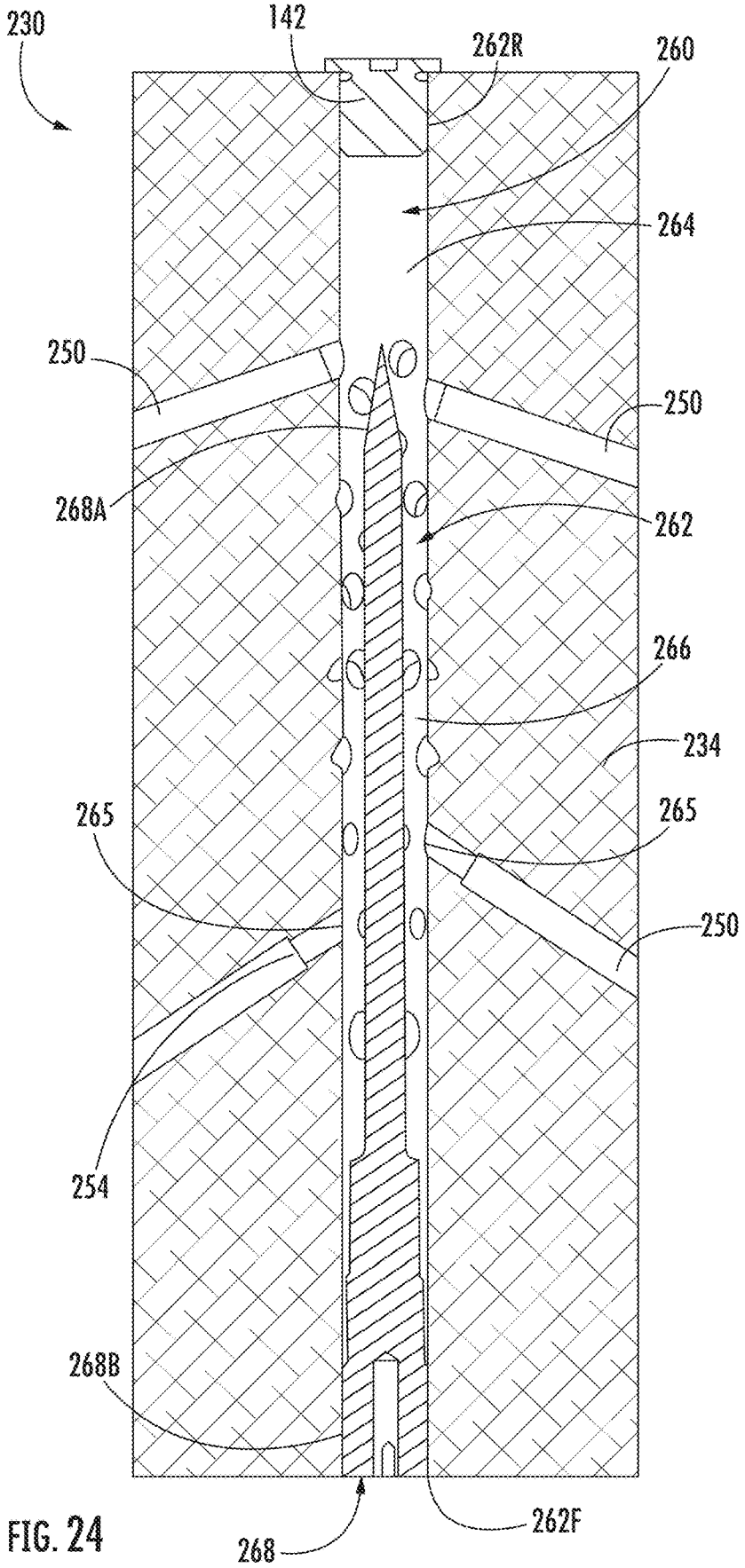
FIG. 24 is a cross-sectional view of the warhead of FIG. 23.
Figure 25:
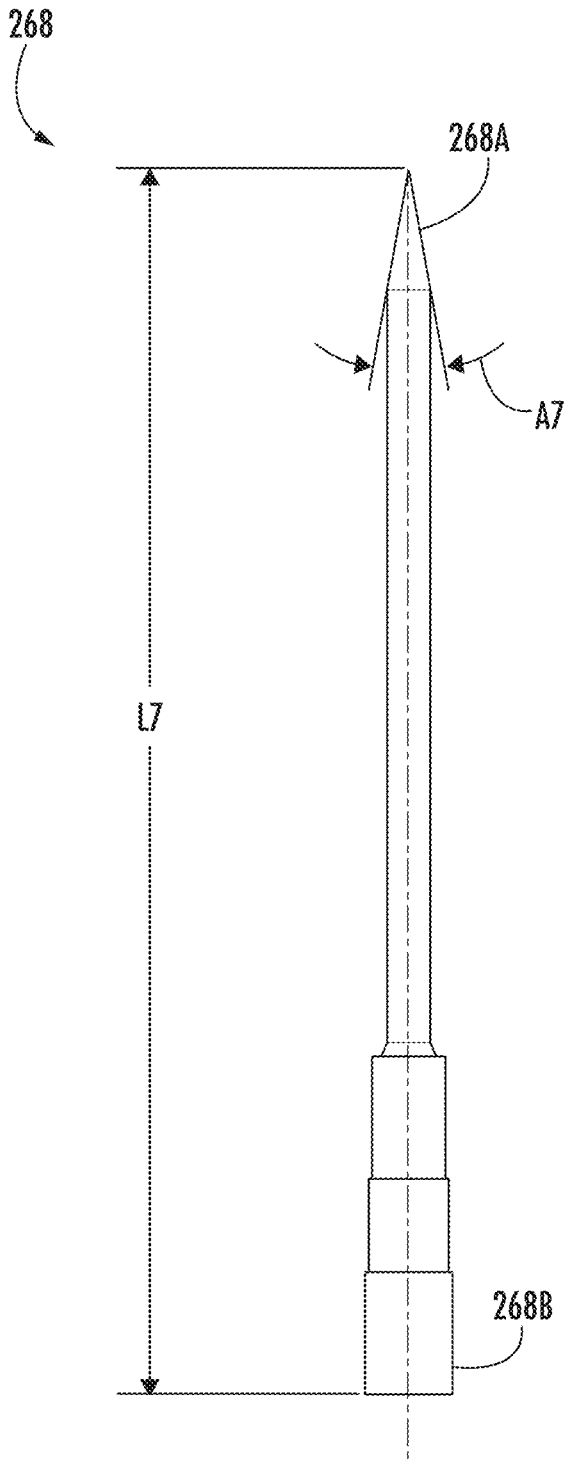
FIG. 25 is a side view of a volume reducer member forming a part of the warhead of FIG. 23.

With reference to FIGS. 23-25, a warhead 230 according to further embodiments is shown therein. The warhead 230 is can be used in the same manner as described for the warhead 130. The warhead 230 is constructed and operated in the same manner as the warhead 130, except as follows.

The pressure delivery system 260 of the warhead 230 includes a pressure chamber or manifold 262 having a rear end 262R and an opposing front end 262F. The manifold 262 includes an entrance section 264 (adjacent the rear end 262R) and a tubular section 266 (adjacent the front end 262F). The tubular section 266 is defined in part by a volume reducer 268 that, along with an inner surface 262B, defines a tubular, axially extending plenum. The volume reducer 268 forms an inner boundary of the manifold 262 and the inner surface 262B of the warhead body defines an outer boundary of the manifold 262. In the illustrated embodiment, the volume reducer 268 is an insert member that is separately formed from the warhead body 234 and installed in a bore 262A of the warhead body 234. The volume reducer 268 includes a tapered or conical rear end or tip 268A and an enlarged front end or plug section 268B.

The volume reducer 268 enables the use of a relatively large diameter chamber or manifold 262 while also maintaining a desirably small manifold volume. The large manifold diameter provides greater circumferential area for intersecting the several barrels 250 (at distribution ports 265 or inlet ports 254) with the manifold 262. By increasing the diameter of the manifold 262, the designer can provide adequate surface area to accommodate as many barrels as might be needed, while limiting the total volume of the manifold 262. The reduced volume prevents undesirable expansion and depressurization of the propellant gas from the gas generator 142. Limiting the total volume of the manifold 262 limits the amount of gas generator reactive to only what is needed to drive the projectiles.

In some embodiments, the volume reducer 268 has a length L7 in the range from 5 cm to 54 cm, a diameter in the range from 8 mm to 25 mm, and a cone angle A7 (of the rear end section 268A) in the range from 35 degrees to 90 degrees. In some embodiments, the volume of the manifold 262 (with the volume reducer 268 installed is in the range of 20 cc to 200 cc.

The size of the volume reducer 268 may be a parameter that is varied as need to control performance of the warhead.

The plug section 268B and the mating receptable portion of the warhead body 234 may have cooperating threads for mounting and securing the volume reducer 268.

The shape of the manifold 262 can be formed by other methods. For example, the volume reducer 268 may be integrally formed with the warhead body 234.

In the above-description of various embodiments of the present disclosure, aspects of the present disclosure may be illustrated and described herein in any of a number of patentable classes or contexts including any new and useful process, machine, manufacture, or composition of matter, or any new and useful improvement thereof. Accordingly, aspects of the present disclosure may be implemented entirely hardware, entirely software (including firmware, resident software, micro-code, etc.) or combining software and hardware implementation that may all generally be referred to herein as a "circuit," "module," "component," or "system." Furthermore, aspects of the present disclosure may take the form of a computer program product comprising one or more computer readable media having computer readable program code embodied thereon.

Any combination of one or more computer readable media may be used. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C#, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages, such as MATLAB. The program code may execute entirely on the user's computer, partly on the user's computer, as a standalone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Aspects of the present disclosure are described herein with reference to flowchart illustrations and/or block diagrams of methods, apparatus (systems), and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

The flowchart and block diagrams in the figures illustrate the architecture, functionality, and operation of possible implementations of systems, methods, and computer program products according to various aspects of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

Many alterations and modifications may be made by those having ordinary skill in the art, given the benefit of present disclosure, without departing from the spirit and scope of the invention. Therefore, it must be understood that the illustrated embodiments have been set forth only for the purposes of example, and that it should not be taken as limiting the invention as defined by the following claims. The following claims, therefore, are to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the invention.

What is claimed:

1. A method for damaging a target, the method comprising:

providing a munition including:

a munition platform;

a warhead on the munition platform for flight therewith, the warhead including:

a gas generator;

a warhead body including a plurality of barrels; and a plurality of projectiles; and actuating the gas generator to generate a pressurized gas that energetically propels the projectiles through and out from the barrels in a forward direction to strike a target and such that the energetically propelled projectiles form a cone of effect;

wherein, after the projectiles are energetically propelled from the barrels, the warhead impacts within the cone of effect while the warhead body is substantially intact.

2. The method of claim 1 wherein:

the gas generator includes a combustible gas generating material; and when the gas generator is actuated, the gas generating material is combusted to generate the pressurized gas.

3. The method of claim 2 wherein the gas generating material is an explosive material.

4. The method of claim 3 wherein, when the gas generator is actuated, the gas generating material deflagrates and is not detonated.

5. The method of claim 4 wherein the gas generating material is a low explosive material.

6. The method of claim 4 wherein the gas generating material is a high explosive material.

7. The method of claim 1 wherein:

the warhead has a leading end and an opposing trailing end, and a warhead axis extending in a forward direction from the trailing end to the leading end; and at least some of the barrels have a barrel axis that extends radially outward relative to the warhead axis.

8. The method of claim 7 wherein at least some of the barrels have a barrel axis the forms an oblique barrel angle relative to the warhead axis.

9. The method of claim 8 wherein at least some of the barrels have a barrel axis that forms an acute barrel angle relative to the warhead axis in the forward direction.

10. The method of claim 9 wherein at least some of the barrels have different barrel angles from one another.

11. The method of claim 1 wherein each barrel includes:

a breech section and projectile guide section;

at least one projectile mounted in the breech section thereof; and a retainer plug holding the at least one projectile in the breech section until the gas generator is actuated.

12. The method of claim 1 wherein at least some of the projectiles are spherical.

13. The method of claim 1 wherein at least some of the projectiles are disc-shaped.

14. The method of claim 1 wherein the warhead includes at least 20 barrels.

15. The method of claim 1 wherein at least one of the barrels includes multiple projectiles disposed therein to be fired.

16. The method of claim 1 wherein the warhead includes a gas generator actuation system configured to actuate the gas generator.

17. The method of claim 1 wherein the gas generator actuation system includes a hot wire.

18. The method of claim 1 wherein the gas generator actuation system includes a shock initiation device.

19. The method of claim 18 wherein the munition includes a seeker subsystem, and the step of actuating the gas generator includes the munition actuating the gas generator responsive to a signal from the seeker subsystem.

20. The munition of claim 19 wherein:

the seeker subsystem includes a height of burst (HOB) sensor; and the step of actuating the gas generator includes the munition actuating the gas generator responsive to a signal from the HOB sensor.

21. The munition of claim 1 wherein the munition platform includes a propulsion system.

22. A method for damaging a target, the method comprising:

providing a warhead including:

a gas generator;

a warhead body including a plurality of barrels; and a plurality of projectiles; and actuating the gas generator to generate a pressurized gas that energetically propels the projectiles through and out from the barrels in a forward direction to strike a target and such that the energetically propelled projectiles form a cone of effect;

wherein, after the projectiles are energetically propelled from the barrels, the warhead impacts within the cone of effect while the warhead body is substantially intact.

23. A warhead comprising:

a gas generator;

a warhead body having an outer surface;

a plurality of barrels in the warhead body; and a plurality of projectiles;

wherein the warhead is configured to selectively actuate the gas generator to generate a pressurized gas that energetically propels the projectiles through and out from the barrels through the exit ports to strike a target; and wherein each barrel includes:

a breech section, an exit port in the outer surface of the warhead body, and a projectile guide section between the breech section and the exit port;

at least one projectile mounted in the breech section thereof;

a retainer plug holding the at least one projectile in the breech section until the gas generator is actuated; and a cover sheet covering the exit port and/or an exit port plug disposed in the exit port.

* * * * *